US010167880B2

(12) United States Patent
Morita

(10) Patent No.: US 10,167,880 B2
(45) Date of Patent: Jan. 1, 2019

(54) SHOVEL AND METHOD OF CONTROLLING SHOVEL

(71) Applicant: SUMITOMO(S.H.I.) CONSTRUCTION MACHINERY CO., LTD., Tokyo (JP)

(72) Inventor: Kenji Morita, Chiba (JP)

(73) Assignee: SUMITOMO(S.H.I.) CONSTRUCTION MACHINERY CO., LTD., Tokyo (JP)

( * ) Notice: Subject to any disclaimer, the term of this patent is extended or adjusted under 35 U.S.C. 154(b) by 385 days.

(21) Appl. No.: 14/994,304

(22) Filed: Jan. 13, 2016

(65) Prior Publication Data

US 2016/0123354 A1 May 5, 2016

Related U.S. Application Data

(63) Continuation of application No. PCT/JP2014/069475, filed on Jul. 23, 2014.

(30) Foreign Application Priority Data

Jul. 24, 2013 (JP) ..... 2013-153884

(51) Int. Cl.
*F02D 23/00* (2006.01)
*F02D 29/04* (2006.01)
(Continued)

(52) U.S. Cl.
CPC ..... *F15B 11/08* (2013.01); *E02F 3/28* (2013.01); *E02F 9/2066* (2013.01);
(Continued)

(58) Field of Classification Search
CPC ..... E02F 9/2066; E02F 9/2217; E02F 9/2296; E02F 9/2292; E02F 9/2285; E02F 9/2246;
(Continued)

(56) References Cited

U.S. PATENT DOCUMENTS 5,468,126 A * 11/1995 Lukich ..... F02D 29/04 123/383
6,155,049 A * 12/2000 Bischoff ..... F02B 37/00 60/602
(Continued)

FOREIGN PATENT DOCUMENTS

JP 2000-073812 3/2000
JP 2008-128107 6/2008
(Continued)

OTHER PUBLICATIONS

International Search Report dated Sep. 16, 2014.

*Primary Examiner* — Michael Leslie
*Assistant Examiner* — Dustin T Nguyen
(74) *Attorney, Agent, or Firm* — IPUSA, PLLC

(57) ABSTRACT

A shovel includes a lower-part traveling body, an upper-part turning body mounted on the lower-part traveling body, a hydraulic actuator mounted on the upper-part turning body, an internal combustion engine disposed in the upper-part turning body, provided with a supercharger, and configured to be controlled at a constant rotational speed, a hydraulic pump connected to the internal combustion engine, and a controller configured to control horsepower absorbed by the hydraulic pump. The controller is configured to increase a load on the internal combustion engine with the hydraulic pump before a load on the hydraulic actuator increases.

18 Claims, 18 Drawing Sheets

(51) Int. Cl.

| | |
|---|---|
| ***F15B 11/08*** | (2006.01) |
| ***E02F 9/22*** | (2006.01) |
| ***F02B 33/34*** | (2006.01) |
| ***F15B 21/08*** | (2006.01) |
| ***E02F 3/28*** | (2006.01) |
| ***E02F 9/20*** | (2006.01) |

(52) U.S. Cl.
CPC ..... *E02F 9/2217* (2013.01); *E02F 9/2235* (2013.01); *E02F 9/2246* (2013.01); *E02F 9/2282* (2013.01); *E02F 9/2285* (2013.01); *E02F 9/2292* (2013.01); *E02F 9/2296* (2013.01); *F02B 33/34* (2013.01); *F15B 21/08* (2013.01); *F02D 23/00* (2013.01); *F15B 2211/20523* (2013.01); *F15B 2211/20546* (2013.01); *F15B 2211/20576* (2013.01); *F15B 2211/212* (2013.01); *F15B 2211/45* (2013.01); *F15B 2211/633* (2013.01); *F15B 2211/6346* (2013.01); *F15B 2211/6651* (2013.01); *F15B 2211/7058* (2013.01); *F15B 2211/88* (2013.01)

(58) Field of Classification Search
CPC ... E02F 9/2235; E02F 3/28; F15B 2211/7058; F15B 2211/633; F15B 2211/45; F15B 2211/212; F15B 2211/20576; F15B 2211/20546; F15B 2211/20523; F15B 2211/6346; F15B 2211/6651; F15B 2211/88; F02B 33/34; F02D 23/00; F02D 23/005; F02D 23/02
USPC ..... 60/459
See application file for complete search history.

(56) References Cited

U.S. PATENT DOCUMENTS

| | | | | |
|---|---|---|---|---|
| 7,805,937 | B2 * | 10/2010 | Cochet | F02D 23/00 123/564 |
| 8,478,470 | B1 | 7/2013 | Meads et al. | |
| 8,924,064 | B2 * | 12/2014 | Magaki | E02F 9/2075 701/22 |
| 9,482,234 | B2 * | 11/2016 | Endo | F04D 25/02 |
| 9,790,664 | B2 * | 10/2017 | Morita | E02F 9/2246 |
| 2004/0258537 | A1 * | 12/2004 | Kim | E02F 9/2221 417/307 |
| 2005/0140342 | A1 | 6/2005 | Maehara et al. | |
| 2005/0160727 | A1 * | 7/2005 | Nakamura | E02F 9/2235 60/431 |
| 2008/0104954 | A1 * | 5/2008 | Schifferer | E02F 9/2235 60/431 |
| 2009/0293470 | A1 * | 12/2009 | Tsukamoto | E02F 9/2228 60/459 |
| 2011/0146283 | A1 * | 6/2011 | Narazaki | E02F 9/2235 60/701 |
| 2012/0185141 | A1 | 7/2012 | Kamado et al. | |
| 2014/0058607 | A1 | 2/2014 | Magaki et al. | |
| 2014/0074337 | A1 | 3/2014 | Magaki et al. | |
| 2016/0356021 | A1 * | 12/2016 | Sugaya | E02F 9/2228 |

FOREIGN PATENT DOCUMENTS

| | | |
|---|---|---|
| JP | 2010-169242 | 8/2010 |
| WO | 2012/169558 | 12/2012 |
| WO | 2012/173160 | 12/2012 |

* cited by examiner

SHOVEL AND METHOD OF CONTROLLING SHOVEL

CROSS-REFERENCE TO RELATED APPLICATIONS

This application is a continuation application filed under 35 U.S.C. 111(a) claiming benefit under 35 U.S.C. 120 and 365(c) of PCT International Application No. PCT/JP2014/069475, filed on Jul. 23, 2014 and designated the U.S., which claims priority to Japanese Patent Application No. 2013-153884, filed on Jul. 24, 2013. The entire contents of the foregoing applications are incorporated herein by reference.

BACKGROUND

Technical Field

The present invention relates to a shovel that performs work by supplying a hydraulic actuator with hydraulic oil discharged by a hydraulic pump driven by an engine, and to a method of controlling the shovel.

Description of Related Art

Recently, as the engines (internal combustion engines) of hydraulic shovels, engines with a turbocharger have often been used. The turbocharger increases the output of the engine by performing supercharging by delivering, to the intake system of the engine, a pressure obtained by rotating a turbine using the engine's exhaust gas.

Specifically, when the driving of a boom is started during the operation of the shovel, a hydraulic load increases, so that an engine load on the engine that has maintained a constant rotational speed increases. In response to this increase in the engine load, the engine increases the engine output by increasing supercharging pressure (boost pressure) and the amount of fuel injection in order to maintain the engine rotational speed.

For example, there is an output control apparatus that performs control so as to increase supercharging pressure for an engine with a turbocharger to increase the engine output in response to detection of a kind of work to increase an engine load, in order to swiftly respond to an increase in the engine load.

SUMMARY

According to an aspect of the present invention, a shovel includes a lower-part traveling body, an upper-part turning body mounted on the lower-part traveling body, a hydraulic actuator mounted on the upper-part turning body, an internal combustion engine disposed in the upper-part turning body, provided with a supercharger, and configured to be controlled at a constant rotational speed, a hydraulic pump connected to the internal combustion engine, and a controller configured to control horsepower absorbed by the hydraulic pump. The controller is configured to increase a load on the internal combustion engine with the hydraulic pump before a load on the hydraulic actuator increases.

According to an aspect of the present invention, a method of controlling a shovel, which includes a lower-part traveling body, an upper-part turning body mounted on the lower-part traveling body, a hydraulic actuator mounted on the upper-part turning body, an internal combustion engine disposed in the upper-part turning body, provided with a supercharger, and configured to be controlled at a constant rotational speed, a hydraulic pump connected to the internal combustion engine, and a controller configured to control horsepower absorbed by the hydraulic pump, includes increasing, by the controller, a load on the internal combustion engine with the hydraulic pump before a load on the hydraulic actuator increases.

It is to be understood that both the foregoing general description and the following detailed description are exemplary and explanatory and not restrictive of the invention.

DETAILED DESCRIPTION

The above-described output control apparatus, however, increases supercharging pressure in response to detection of an increase in a hydraulic load, that is, increases supercharging pressure after a hydraulic load due to an external force such as an excavation reaction force increases to some extent. Therefore, in such a case where a hydraulic load suddenly increases relative to the output of the engine because of an external force such as an excavation reaction force, it is not possible to cause an increase in the supercharging pressure to follow the increase in the hydraulic load, so that the engine may be stopped because of shortage of the engine output.

According to an aspect of the present invention, a shovel capable of maintaining engine output even when it is difficult to increase supercharging pressure as required and a method of controlling the shovel are provided.

Figure 1:
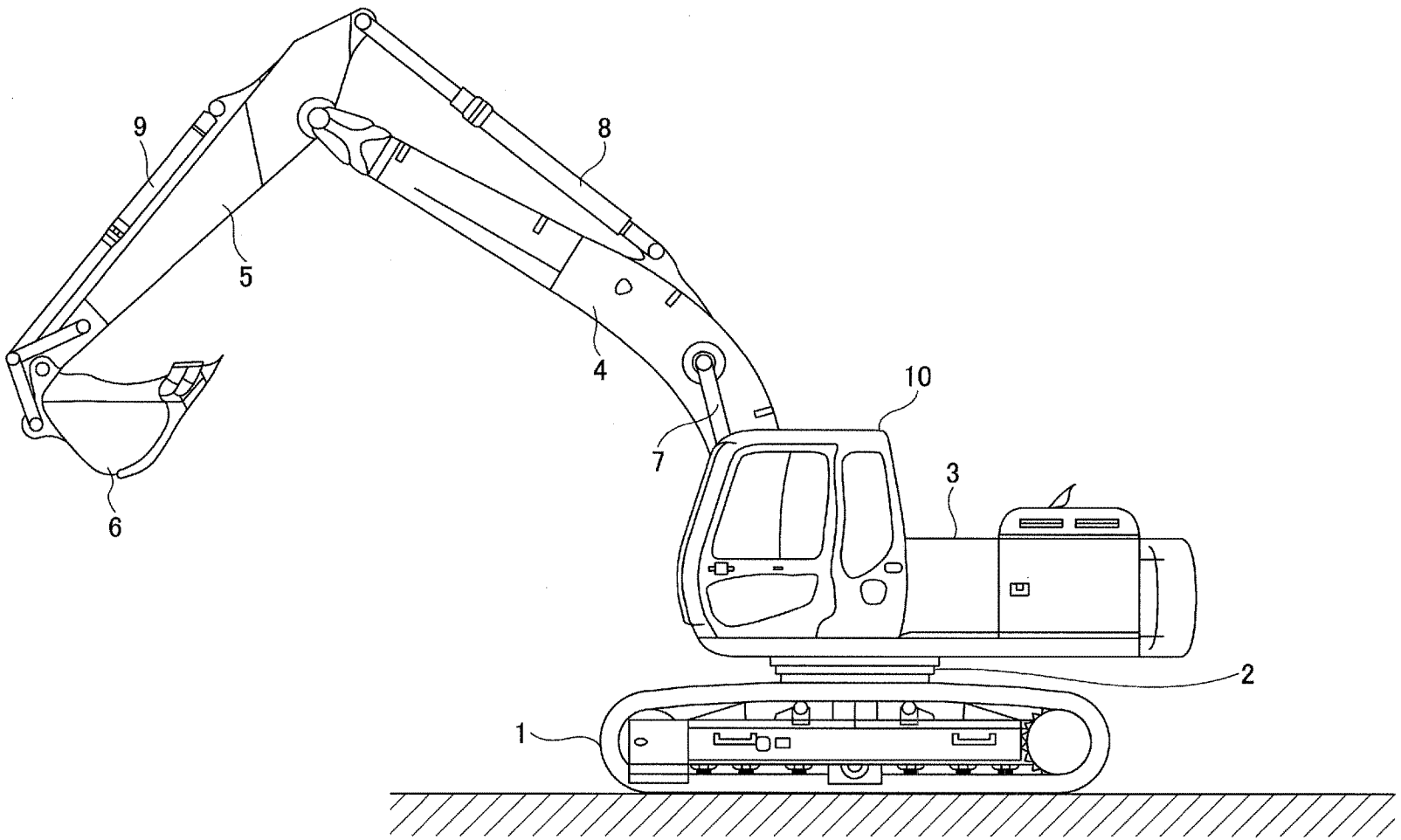
FIG. 1 is a side view of a shovel according to an embodiment of the present invention.

First, a description is given, with reference to FIG. 1, of a shovel according to an embodiment of the present invention. FIG. 1 is a side view of a shovel according to this embodiment. An upper-part turning body 3 is mounted on a lower-part traveling body 3 of the shovel illustrated in FIG. 1 via a turning mechanism 2. A boom 4 is attached to the upper-part turning body 3. An arm 5 is attached to an end of the boom 4, and a bucket 6 serving as an end attachment is attached to an end of the arm 5. The boom 4, the arm 5, and the bucket 6 are hydraulically driven by a boom cylinder 7, an arm cylinder 8, and a bucket cylinder 9, respectively. A cabin 10 is provided and power sources such as an engine 11 are mounted on the upper-part turning body 3.

Figure 2:
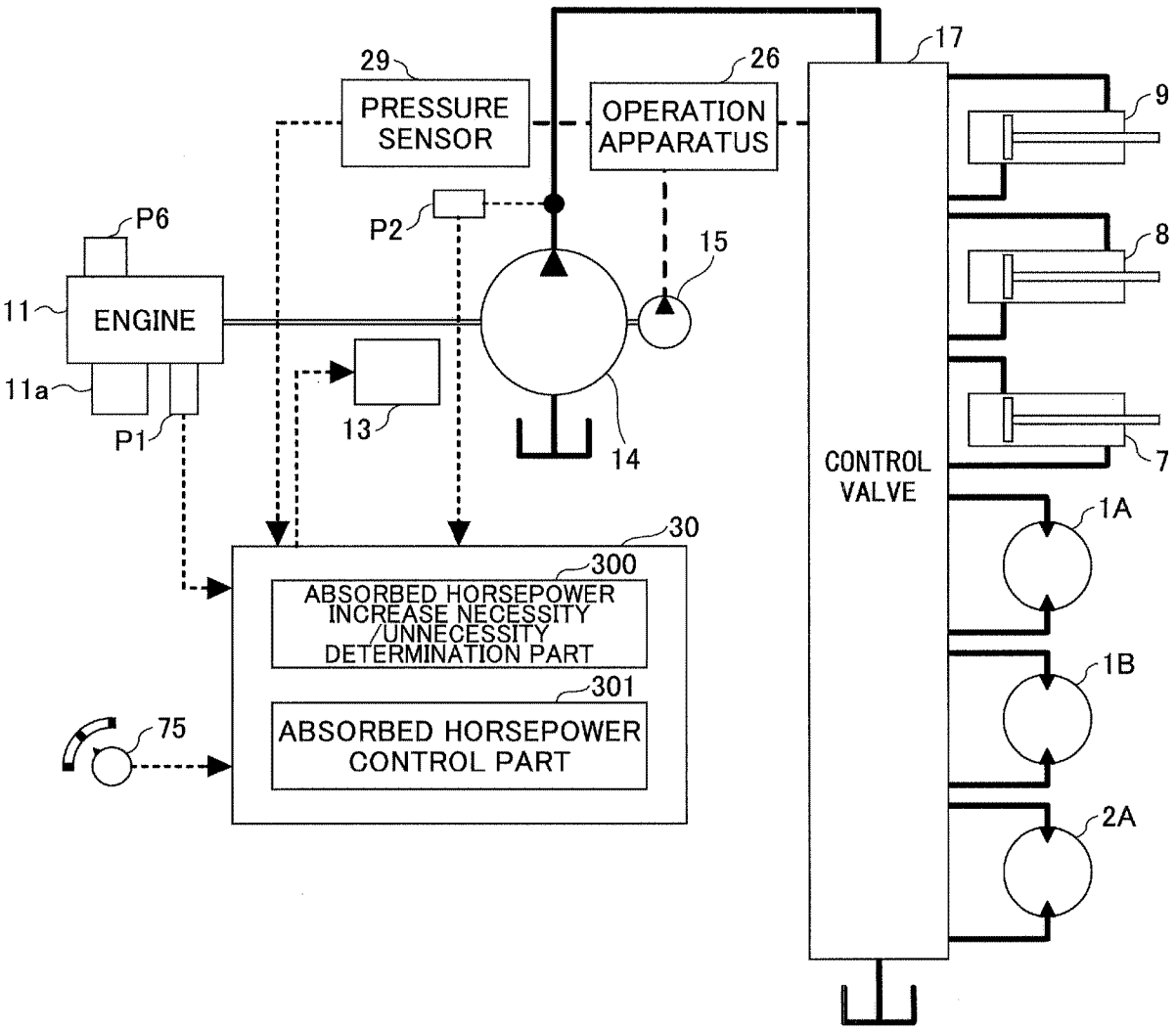
FIG. 2 is a block diagram illustrating a configuration of a drive system of the shovel of FIG. 1.

FIG. 2 is a block diagram illustrating a configuration of a drive system of the shovel of FIG. 1, indicating a mechanical power system, a high-pressure hydraulic line, a pilot line, and an electric control system by a double line, a bold solid line, a broken line, and a dotted line, respectively.

The drive system of the shovel 1 mainly includes the engine 11, a regulator 13, a main pump 14, a pilot pump 15, a control valve 17, an operation apparatus 26, a pressure sensor 29, a controller 30, an atmospheric pressure sensor P1, a discharge pressure sensor P2, an engine rotational speed detector P6, and an engine rotational speed adjustment dial 75.

The engine 11 is the drive source of the shovel, and is, for example, a diesel engine serving as an internal combustion engine that operates so as to maintain a predetermined rotational speed. The output shaft of the engine 11 is connected to the input shafts of the main pump 14 and the pilot pump 15. According to this embodiment, the engine 11 is provided with a supercharging device 11*a*. The supercharging device 11*a* is, for example, a turbocharger that increases intake pressure (generates supercharging pressure) using exhaust gas from the engine 11. The supercharging device 11*a* may be a supercharger that generates supercharging pressure using the rotation of the output shaft of the engine 11. This configuration makes it possible for the engine 11 to increase the engine output by increasing supercharging pressure in accordance with a load increase.

The main pump 14 is an apparatus for supplying hydraulic oil to the control valve 17 via a high-pressure hydraulic line, and is, for example, a swash-plate variable displacement hydraulic pump.

The regulator 13, which is a device for controlling the discharge quantity of the main pump 14, controls the discharge quantity of the main pump 14 by, for example, adjusting the swash plate tilt angle of the main pump 14 in accordance with the discharge pressure of the main pump 14, a control signal from the controller 30, or the like.

The pilot pump 15 is an apparatus for supplying hydraulic oil to hydraulic control apparatuses via a pilot line, and is, for example, a fixed displacement hydraulic pump.

The control valve 17 is a hydraulic controller that controls the hydraulic system of the shovel. The control valve 17, for example, supplies hydraulic oil discharged by the main pump 14 selectively to one or more of the boom cylinder 7, the arm cylinder 8, the bucket cylinder 9, a traveling hydraulic motor LA (for the left), a traveling hydraulic motor 1B (for the right), and a turning hydraulic motor 2A. In the following, the boom cylinder 7, the arm cylinder 8, the bucket cylinder 9, the traveling hydraulic motor 1A (for the left), the traveling hydraulic motor 1B (for the right), and the turning hydraulic motor 2A are collectively referred to as "hydraulic actuators."

The operation apparatus 26 is an apparatus that an operator uses to operate the hydraulic actuators, and supplies hydraulic oil discharged by the pilot pump 15 to the pilot ports of flow control valves corresponding to the individual hydraulic actuators via a pilot line. The pressure (pilot pressure) of hydraulic oil supplied to each pilot port is a pressure commensurate with the direction of operation and the amount of operation of a lever or pedal (not graphically illustrated) of the operation apparatus 26 corresponding to each hydraulic actuator.

The pressure sensor 29 is a sensor for detecting the contents of the operator's operation using the operation apparatus 26, and, for example, detects the direction of operation and the amount of operation of a lever or pedal of the operation apparatus 26 corresponding to each hydraulic actuator in the form of pressure and outputs a detected value to the controller 30. The contents of an operation of the operation apparatus 26 may be detected using a sensor other than a pressure sensor.

The controller 30 is a control device for controlling the shovel, and is composed of, for example, a computer including a CPU (Central Processing Unit), a RAM (Random Access Memory), and a ROM (Read Only Memory). Furthermore, the controller reads programs corresponding to an absorbed horsepower increase necessity/unnecessity determination part 300 and an absorbed horsepower control part (discharge quantity control part) 301, loads the programs into the RAM, and causes the CPU to execute processes corresponding to the programs.

Specifically, the controller 30 receives detected values output by the pressure sensor 29 and the like, and executes processes by the absorbed horsepower increase necessity/unnecessity determination part 300 and the absorbed horsepower control part (discharge quantity control part) 301 based on the detected values. Thereafter, the controller 30 suitably outputs, to the regulator 13, etc., a control signal according to the respective processing results of the absorbed horsepower increase necessity/unnecessity determination part 300 and the absorbed horsepower control part (discharge quantity control part) 301.

To be more specific, the absorbed horsepower increase necessity/unnecessity determination part 300 determines whether it is necessary to increase the horsepower absorbed by the main pump 14. When the absorbed horsepower increase necessity/unnecessity determination part 300 determines that it is necessary to increase the horsepower absorbed by the main pump 14, the absorbed horsepower control part (discharge quantity control part) 301 adjusts the regulator 13 to increase the discharge quantity of the main pump 14.

Thus, the controller 30 increases the discharge quantity of the main pump 14 in order to automatically increase the horsepower absorbed by the main pump 14 as required. "Automatically increasing absorbed horsepower" means increasing absorbed horsepower independent of an external force such as an excavation reaction force, and specifically means, for example, increasing the horsepower absorbed by a hydraulic pump regardless of an increase or decrease in a reaction force that the bucket 6 serving as an end attachment receives from a work target.

The atmospheric pressure sensor P1 is a sensor for detecting atmospheric pressure, and outputs a detected value to the controller 30. The discharge pressure sensor P2 is a sensor for detecting the discharge pressure of the main pump 14, and outputs a detected value to the controller 30.

The engine rotational speed adjustment dial 75 is a device for switching the engine rotational speed. According to this embodiment, the engine rotational speed adjustment dial 75 is capable of switching the engine rotational speed among three or more levels. The engine 11 is controlled to a constant rotational speed at the engine rotational speed set with the engine rotational speed adjustment dial 75.

The engine rotational speed detector P6 is a device that detects the rotational speed of the engine 11, and outputs a detected value to the controller 30.

Figure 3:
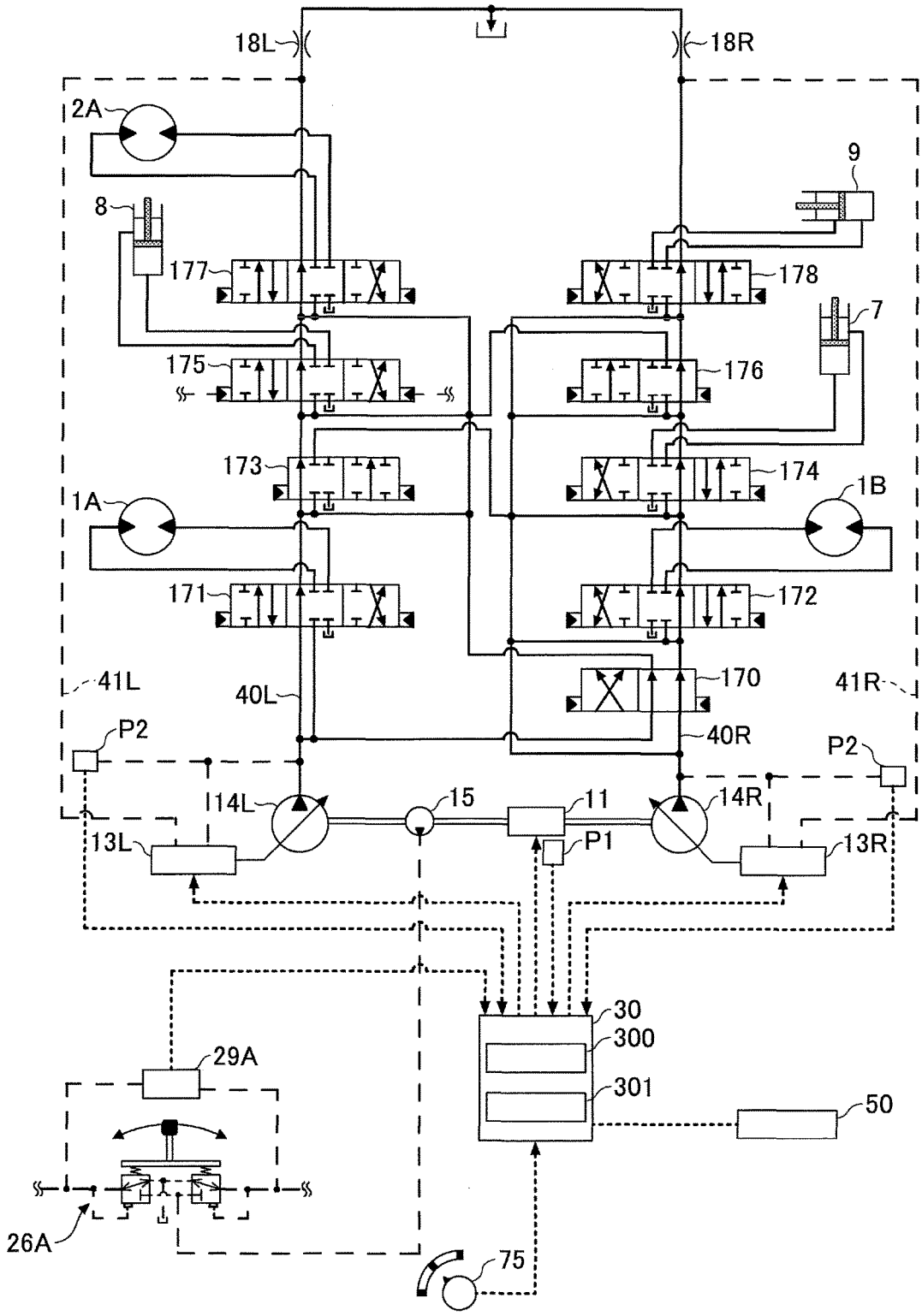
FIG. 3 is a schematic diagram illustrating a configuration of a hydraulic system installed in the shovel of FIG. 1.

Here, a description is given, with reference to FIG. 3, of a mechanism to vary the discharge quantity of the main pump 14. FIG. 3 is a schematic diagram illustrating a configuration of a hydraulic system installed in the shovel of FIG. 1, indicating a mechanical power system, a high-pressure hydraulic line, a pilot line, and an electric control system by a double line, a bold solid line, a broken line, and a dotted line, respectively, the same as FIG. 2.

In FIG. 3, the hydraulic system circulates hydraulic oil from main pumps 14L and 14R driven by the engine 11 to a hydraulic oil tank via center bypass conduits 40L and 40R, respectively. The main pumps 14L and 14R correspond to the main pump 14 of FIG. 2.

The center bypass conduit 40L is a high-pressure hydraulic line that passes through flow control valves 171, 173, 175 and 177 disposed in the control valve 17. The center bypass conduit 40R is a high-pressure hydraulic line that passes through flow control valves 170, 172, 174, 176 and 178 disposed in the control valve 17.

The flow control valves 173 and 174 are spool valves that switch a flow of hydraulic oil in order to supply the boom cylinder 7 with hydraulic oil discharged by the main pumps 14L and 14R and discharge hydraulic oil in the boom cylinder 7 to the hydraulic oil tank. The flow control valve 174 is a spool valve that operates every time a boom operation lever 26A is operated. The flow control valve 173 is a spool valve that operates only when the boom operation lever 26A is operated for a predetermined operation amount or more.

The flow control valves 175 and 176 are spool valves that switch a flow of hydraulic oil in order to supply the arm cylinder 8 with hydraulic oil discharged by the main pumps 14L and 14R and discharge hydraulic oil in the arm cylinder 8 to the hydraulic oil tank. The flow control valve 175 is a valve that operates every time an arm operation lever (not graphically illustrated) is operated. The flow control valve 176 is a valve that operates only when the arm operation lever is operated for a predetermined operation amount or more.

The flow control valve 177 is a spool valve that switches a flow of hydraulic oil in order to circulate hydraulic oil discharged by the main pump 14L in the turning hydraulic motor 2A.

The flow control valve 178 is a spool valve for supplying the bucket cylinder 9 with hydraulic oil discharged by the main pump 14R and discharging hydraulic oil in the bucket cylinder 9 to the hydraulic oil tank.

Regulators 13L and 13R control the discharge quantities of the main pumps 14L and 14R by adjusting the swash plate tilt angles of the main pumps 14L and 14R in accordance with the discharge pressures of the main pumps 14L and 14R, respectively. The regulators 13L and 13R correspond to the regulator 13 of FIG. 2. Specifically, the regulators 13L and 13R reduce the discharge quantities by adjusting the swash plate tilt angles of the main pumps 14L and 14R when the discharge pressures of the main pump 14L and 14R become a predetermined value or more, in order to prevent the horsepower absorbed by the main pump 14, which is expressed as the product of a discharge pressure and a discharge quantity, from exceeding the output horsepower of the engine 11. In the following, this control is referred to as "total horsepower control".

The boom operation lever 26A is an example of the operation apparatus 26, and is used to operate the boom 4. Furthermore, the boom operation lever 26A introduces a control pressure commensurate with the amount of a lever operation into either a right or a left pilot port of the flow control valve 174, using hydraulic oil discharged by the pilot pump 15. The boom operation lever 26A introduces hydraulic oil to either a right or a left pilot port of the flow control valve 173 as well when the amount of a lever operation is a predetermined operation amount or more.

A pressure sensor 29A, which is an example of the pressure sensor 29, detects the contents of the operator's operation on the boom operation lever 26A in the form of pressure, and outputs a detected value to the controller 30. Examples of the contents of an operation include the direction of a lever operation and the amount of a lever operation (the angle of a lever operation).

Right and left traveling levers (or pedals), the arm operation lever, a bucket operation lever, and a turning operation lever (none of which is graphically illustrated) are operation apparatuses for the operations of causing the lower-part traveling body 1 to travel, opening and closing the arm 5, opening and closing the bucket 6, and turning the upper-part turning body 3, respectively. Like the boom operation lever 26A, each of these operation apparatuses introduces a control pressure commensurate with the amount of a lever operation (or the amount of a pedal operation) to either a right or a left pilot port of a flow control valve corresponding to a hydraulic actuator, using hydraulic oil discharged by the pilot pump 15. Furthermore, the contents of the operator's operation on each of these operation apparatuses is detected in the form of pressure by a corresponding pressure sensor the same as by the pressure sensor 29A, and a detected value is output to the controller 30.

The controller 30 receives the output signals of the pressure sensor 29A and the like, and outputs control signals to the regulators 13L and 13R to change the discharge quantities of the main pumps 14L and 14R as required.

A switch 50 is a switch to switch the activation and the stop of the controller 30's operation of automatically increasing the horsepower absorbed by the main pump 14 (hereinafter referred to as "absorbed horsepower increasing operation"), and is provided in, for example, the cabin 10. The operator selects the ON position of the switch 50 to activate the absorbed horsepower increasing operation, and selects the OFF position of the switch 50 to stop the absorbed horsepower increasing operation. Specifically, when the OFF position of the switch 50 is selected, the controller 30 stops execution of the absorbed horsepower increase necessity/unnecessity determination part 300 and the absorbed horsepower control part (discharge quantity control part) 301, and disables their functions.

Here, a description is given of a negative control employed in the hydraulic system of FIG. 3.

The center bypass conduits 40L and 40R include negative control throttles 18L and 18R between the flow control valves 177 and 178 at the most downstream positions and the hydraulic oil tank, respectively. A flow of hydraulic oil discharged by the main pumps 14L and 14R is restricted by the negative control throttles 18L and 18R. The negative control throttles 18L and 18R generate control pressures for controlling the regulators 13L and 13R (hereinafter, "negative control pressures").

Negative control pressure conduits 41L and 41R indicated by a broken line are pilot lines for conveying the negative control pressures generated on the upstream side of the negative control throttles 18L and 18R to the regulators 13L and 13R.

The regulators 13L and 13R control the discharge quantities of the main pumps 14L and 14R by adjusting the swash plate tilt angles of the main pumps 14L and 14R in accordance with the negative control pressures. Furthermore, the regulators 13L and 13R decrease the discharge quantities of the main pumps 14L and 14R as the introduced negative control pressures increase, and increase the discharge quantities of the main pumps 14L and 14R as the introduced negative control pressures decrease.

Specifically, as illustrated in FIG. 3, when none of the hydraulic actuators in the shovel is operated (hereinafter, "standby mode"), the hydraulic oil discharged by the main pump 14L and 14R passes through the center bypass conduits 40L and 40R to arrive at the negative control throttles 18L and 18R. A flow of the hydraulic oil discharged by the main pumps 14L and 14R increases negative control pressures generated on the upstream side of the negative control throttles 18L and 18R. As a result, the regulators 13L and 13R decrease the discharge quantities of the main pumps 14L and 14R to a minimum allowable discharge quantity so as to reduce a pressure loss (pumping loss) at the time of passage of the discharged hydraulic oil through the center bypass conduits 40L and 40R.

On the other hand, when any of the hydraulic actuators is operated, the hydraulic oil discharged by the main pumps 14L and 14R flows into the hydraulic actuator that is a target of operation through a flow control valve corresponding to the hydraulic actuator that is a target of operation. Then, a flow of the hydraulic oil discharged by the main pumps 14L and 14R that arrives at the negative control throttles 18L and 18R is reduced in amount or disappears so as to reduce negative control pressures generated on the upstream side of the negative control throttles 18L and 18R. As a result, the regulators 13L and 13R that receive the reduced negative control pressures increase the discharge quantities of the main pumps 14L and 14R so as to circulate sufficient hydraulic oil to the hydraulic actuator that is a target of operation, thus ensuring the driving of the hydraulic actuator that is a target of operation.

The configuration as described above makes it possible for the hydraulic system of FIG. 3 to reduce unnecessary energy consumption in the main pumps 14L and 14R in the standby mode. The unnecessary energy consumption includes a pumping loss generated in the center bypass conduits 40L and 40R by the hydraulic oil discharged by the main pumps 14L and 14R.

Furthermore, the hydraulic system of FIG. 3 makes it possible to ensure a supply of necessary and sufficient hydraulic oil from the main pumps 14L and 14R to the hydraulic actuator that is a target of operation at the time of activating the hydraulic actuator.

Figure 4:
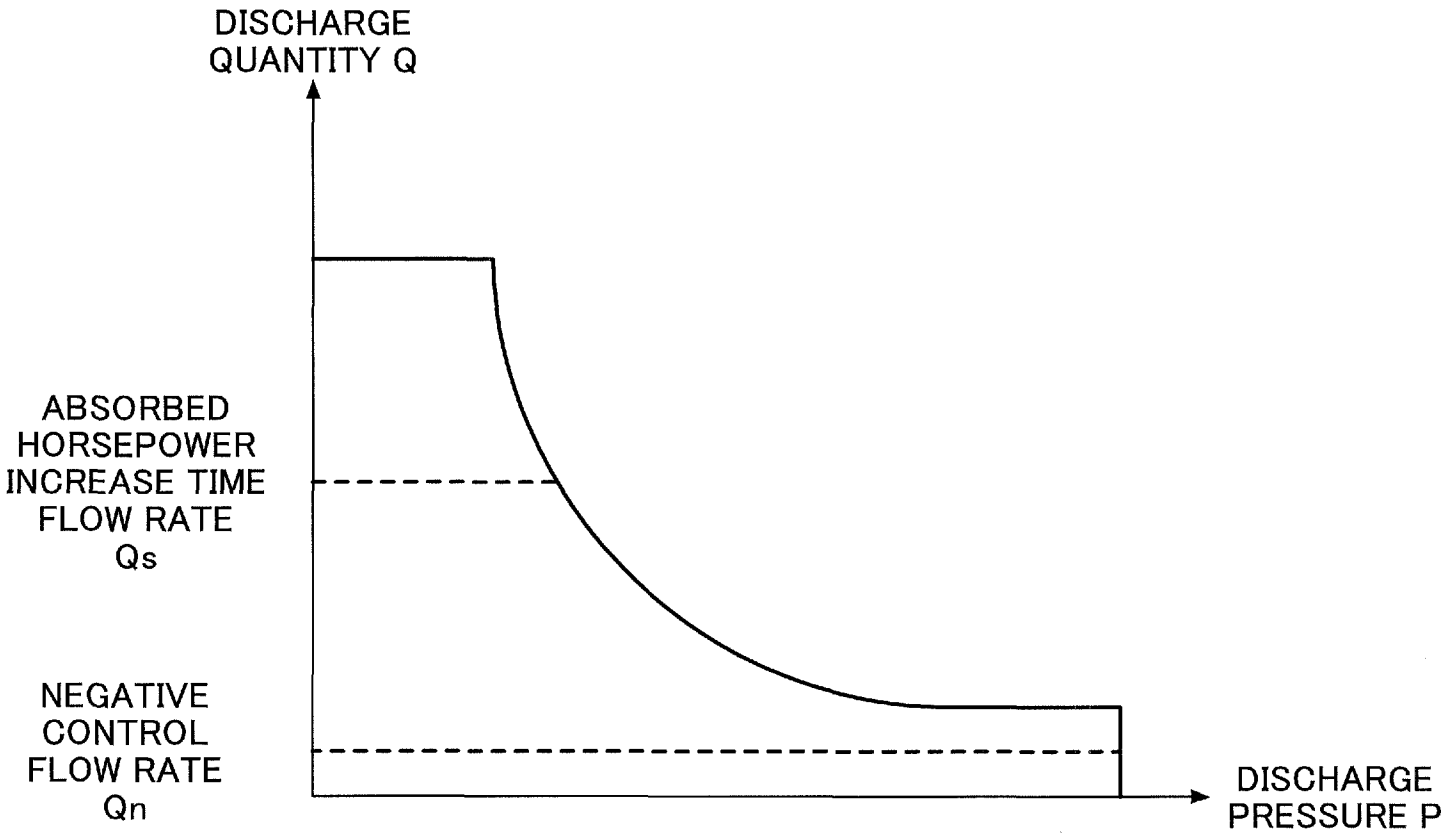
FIG. 4 is a graph illustrating an example of the relationship between the discharge quantity and the discharge pressure of a main pump.

Next, a description is given, with reference to FIG. 4, of the relationship between the total horsepower control and the negative control by the regulator 13. FIG. 4 is a graph illustrating an example of the relationship between the discharge quantity Q of the main pump 14 and the discharge pressure P of the main pump 14 or the negative control pressure.

The regulator 13 controls the discharge quantity Q of the main pump 14 in accordance with a total horsepower control curve indicated by a solid line in FIG. 4. Specifically, the regulator 13 reduces the discharge quantity Q as the discharge pressure P increases so as to prevent the horsepower absorbed by the main pump 14 from exceeding the engine output. Furthermore, aside from the total horsepower control, the regulator 13 controls the discharge quantity Q of the main pump 14 in accordance with the negative control pressure. Specifically, the regulator 13 reduces the discharge quantity Q as the negative control pressure increases, and reduces the discharge quantity Q to a negative control flow rate Qn as a minimum allowable discharge quantity when the negative control pressure further increases to exceed a predetermined value. As a result, the negative control pressure decreases to a predetermined pressure Pn, while the regulator 13 keeps the discharge quantity Q remaining at the negative control flow rate Qn without increase until the negative control pressure falls below a negative control cancellation pressure Pr (<Pn).

Furthermore, according to this embodiment, aside from the total horsepower control and the negative control, the regulator 13 controls the discharge quantity Q of the main pump 14 in accordance with a control signal from the controller 30. Specifically, the regulator 13 adjusts the discharge quantity Q to an absorbed horsepower increase time flow rate Qs that is greater than the negative control flow rate Qn in accordance with a control signal that the controller 30 outputs when the absorbed horsepower increase necessity/unnecessity determination part 300 determines that it is necessary to increase the horsepower absorbed by the main pump 14. In this case, the regulator 13 keeps the discharge quantity Q remaining at the absorbed horsepower increase time flow rate Qs without a decrease to the negative control flow rate Qn even when the negative control pressure increases.

To be more specific, for example, when the shovel in the standby mode, the absorbed horsepower increase necessity/unnecessity determination part 300 determines that it is necessary to increase the horsepower absorbed by the main pump 14. Then, the absorbed horsepower control part (discharge quantity control part) 301 outputs a control signal to the regulator 13 so that the discharge quantity Q of the main pump 14 is adjusted to the absorbed horsepower increase time flow rate Qs.

Figure 5:
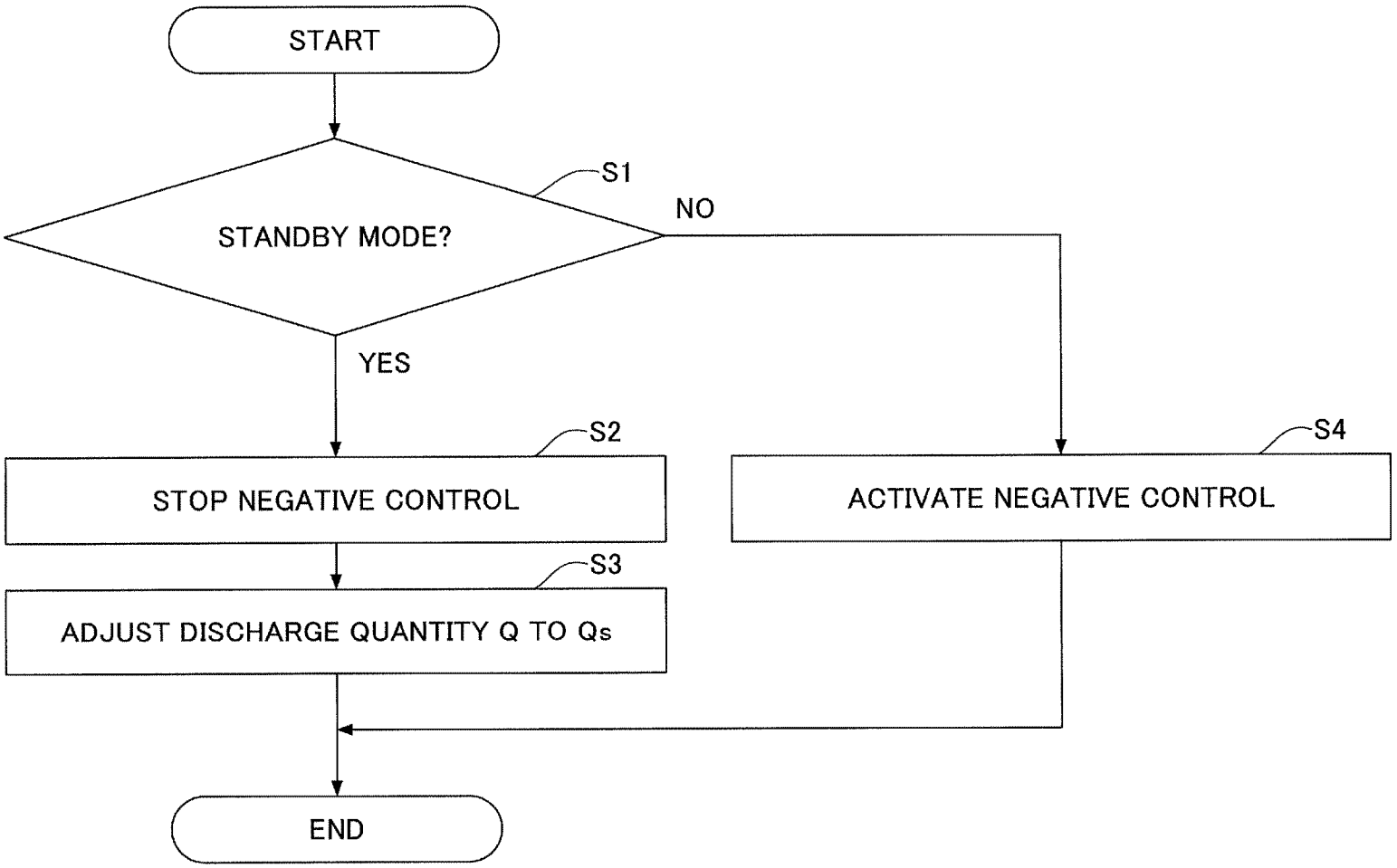
FIG. 5 is a flowchart illustrating a flow of an absorbed horsepower increasing operation.

Next, a description is given, with reference to FIG. 5, of an example of the operation of increasing the horsepower absorbed by the main pump 14 as required (hereinafter, "absorbed horsepower increasing operation") by the controller 30 of the shovel according to this embodiment. FIG. 5 is a flowchart illustrating a flow of the absorbed horsepower increasing operation, and the controller 30 repeatedly executes this absorbed horsepower increasing operation at predetermined intervals. Furthermore, according to this embodiment, the shovel is in an environment of low atmospheric pressures, such as at high altitudes, and the ON position of the switch 50 is manually selected. Accordingly, it is possible for the controller 30 to cause the absorbed horsepower increase necessity/unnecessity determination part 300 and the absorbed horsepower control part (discharge quantity control part) 301 to effectively function.

First, the absorbed horsepower increase necessity/unnecessity determination part 300 of the controller 30 determines whether the shovel is in the standby mode (step S1).

According to this embodiment, the absorbed horsepower increase necessity/unnecessity determination part 300 determines whether the shovel is in the standby mode based on whether or not the discharge pressure of the main pump 14 is a predetermined pressure or more. For example, the absorbed horsepower increase necessity/unnecessity determination part 300 determines that the shovel is in the standby mode if the discharge pressure of the main pump 14 is less than a predetermined pressure. Alternatively, the absorbed horsepower increase necessity/unnecessity determination part 300 may determine whether the shovel is in the standby mode based on the pressures of the hydraulic actuators.

If the absorbed horsepower increase necessity/unnecessity determination part 300 determines that the shovel is in the standby mode (there is no hydraulic load) (YES at step S1), the controller 30 stops the negative control (step S2). Then, the controller 30 adjusts the discharge quantity Q of the main pump 14 to the absorbed horsepower increase time flow rate Qs that is greater than the negative control flow rate Qn (step S3). According to this embodiment, the absorbed horsepower control part (discharge quantity control part) 301 of the controller 30 outputs a control signal to the regulator 13. In response to reception of the control signal, the regulator 13 stops adjusting the swash plate tilt angle according to the negative control pressure. Then, the regulator 13 adjusts the swash plate tilt angle to a predetermined angle according to a predetermined control pressure so as to increase the discharge quantity Q of the main pump 14 to the absorbed horsepower increase time flow rate Qs. As a result, even in the standby mode, it is possible to impose a load sufficient to increase supercharging pressure on the engine 11. The predetermined control pressure is generated based on, for example, hydraulic oil discharged by the pilot pump 15.

On the other hand, if the absorbed horsepower increase necessity/unnecessity determination part 300 determines that the shovel is not in the standby mode (there is a hydraulic load) (NO at step S1), the controller 30 activates the negative control (step S4). Then, the controller 30 adjusts the discharge quantity Q of the main pump 14 to a flow rate corresponding to the negative control pressure within the range of the total horsepower control curve (see FIG. 4).

Thus, the controller 30 increase the horsepower absorbed by the main pump 14 in the standby mode. Therefore, by automatically imposing a predetermined load on the engine 11, it is possible for the controller 30 to increase supercharging pressure in the supercharging device 11*a* even when there is no hydraulic load due to an external force such as an excavation reaction force. That is, it is possible to increase supercharging pressure by a predetermined amount in advance prior to a hydraulic load increase due to an external force without directly controlling the engine 11 and the supercharging device 11*a*. As a result, even when a low atmospheric pressure prevents a rapid increase in supercharging pressure, it is possible to generate a supercharging pressure that matches an increasing hydraulic load before a decrease in the engine rotational speed (a decrease in workability) or an engine stall is caused.

Figure 6:
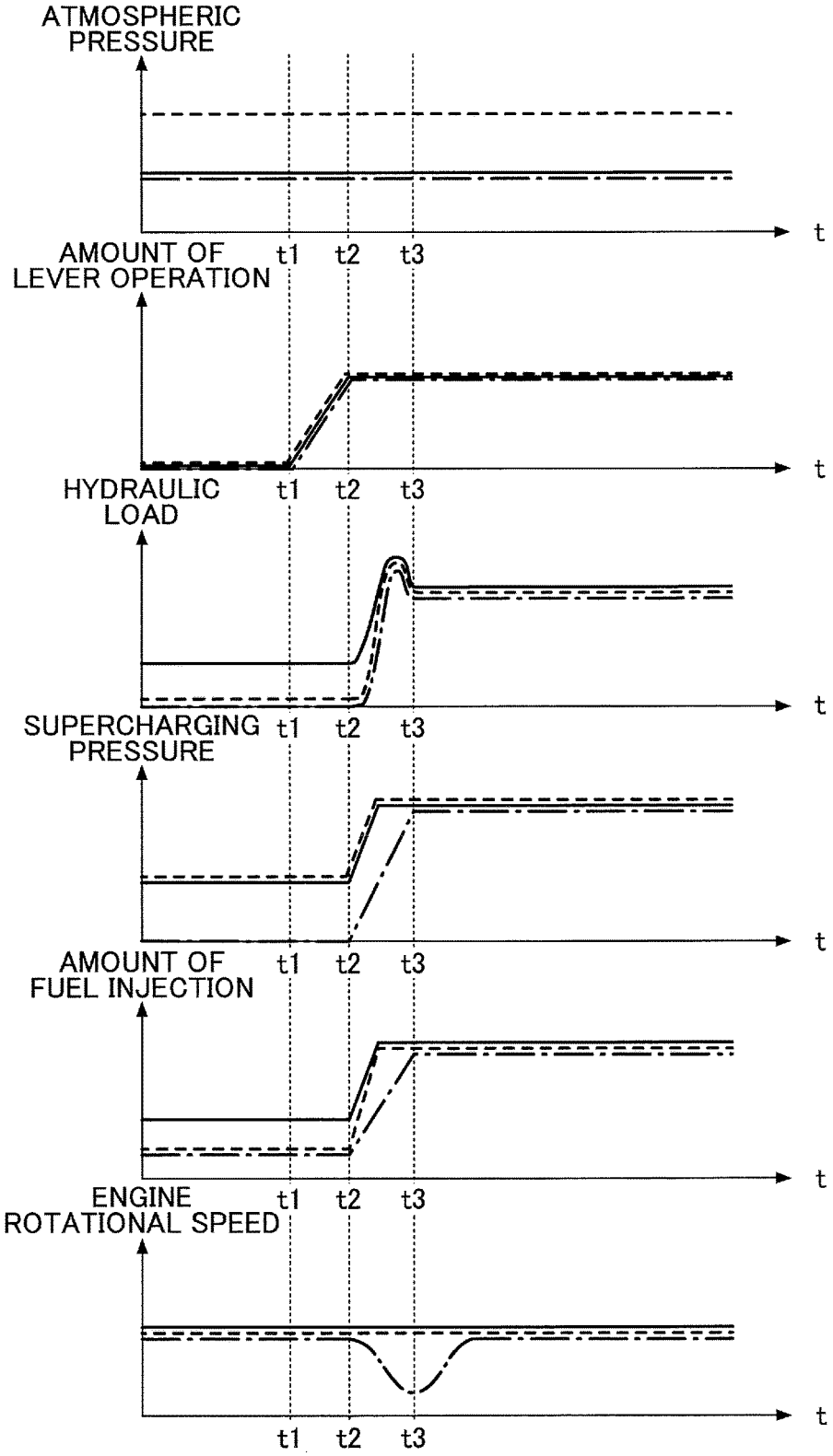
FIG. 6 is a chart illustrating temporal transitions of various physical quantities in the case of executing the absorbed horsepower increasing operation of FIG. 5.

Next, a description is given, with reference to FIG. 6, of temporal transitions of various physical quantities in the case of executing the absorbed horsepower increasing operation. FIG. 6 is a chart illustrating temporal transitions of such various physical quantities, showing the respective temporal transitions of, in order from top to bottom, atmospheric pressure, the amount of a lever operation, a hydraulic load (the horsepower absorbed by the main pump 14), supercharging pressure, the amount of fuel injection, and the engine rotational speed. Furthermore, the transitions indicated by a broken line in FIG. 6 indicate transitions in the case of not executing the absorbed horsepower increasing operation when the shovel is at low altitudes (in an environment of relatively high atmospheric pressures), and the transitions indicated by a one-dot chain line in FIG. 6 indicate transitions in the case of not executing the absorbed horsepower increasing operation when the shovel is at high altitudes (in an environment of relatively low atmospheric pressures). Furthermore, the transitions indicated by a solid line in FIG. 6 indicate transitions in the case of executing the absorbed horsepower increasing operation when the shovel is at high altitudes (in an environment of relatively low atmospheric pressures). In an environment of relatively low atmospheric pressures, such as at high altitudes, an attempt may be made to increase supercharging pressure upon detection of a hydraulic load increase, but it is not possible to cause as much increase in supercharging pressure as in an environment of relatively high atmospheric pressures. Therefore, the engine may stall because of shortage of the engine output.

According to this embodiment, it is assumed that, for example, a lever operation for moving the arm 5 for excavation is performed at time t1.

First, for comparison, a description is given of temporal transitions of various physical quantities in the case of not executing the absorbed horsepower increasing operation when the shovel is at low altitudes (in an environment of relatively high atmospheric pressures) and in the case of not executing the absorbed horsepower increasing operation when the shovel is at high altitudes (in an environment of relatively low atmospheric pressures).

At time t1, an operation of the arm operation lever is started in order to perform an excavating action. The amount of operation of the arm operation lever (an angle at which the operation lever is tilted) increases from time t1 to time t2, and at time t2, the amount of operation of the arm operation lever is fixed. That is, the arm operation lever is operated and tilted from time t1, and the tilt of the arm operation lever is fixed at time t2. When an operation of the arm operation lever is started at time t1, the arm 5 starts moving, and at time t2, the tilt of the arm operation lever is maximized, so that the tilt of the arm 5 is maximized.

From time t2 at which the tilt of the arm operation lever is maximized, the discharge pressure of the main pump 14 increases because of a load applied to the arm 5, so that the hydraulic load on the main pump 14 starts to increase. That is, the hydraulic load on the main pump 14 starts to increase from around time t2 as indicated by a broken line and a one-dot chain line. Furthermore, the hydraulic load on the main pump 14 corresponds to a load on the engine 11, and the load on the engine 11 as well starts to increase along with the hydraulic load on the main pump 14. Here, the time taken before the hydraulic load reaches a peak after the start of the lever operation at time t1 is approximately less than one second. As a result, the rotational speed of the engine 11 is maintained at a predetermined rotational speed as indicated by a broken line when the shovel is at low altitudes (in an environment of relatively high atmospheric pressures), while the rotational speed of the engine 11 starts to significantly decrease around after time t2 as indicated by a one-dot chain line when the shovel is at high altitudes (in an environment of relatively low atmospheric pressures). This is because an engine output that matches a load on the engine 11 cannot be attained because of low supercharging pressure in an environment of relatively low atmospheric pressures.

Specifically, when a load on the engine 11 increases, normally, control on the engine 11 works so that the amount of fuel injection increases. As a result, the flow rate of exhaust gas increases to increase supercharging pressure, so that the combustion efficiency of the engine 11 increases to increase the output of the engine 11. During a period of low supercharging pressure, however, an increase in the amount of fuel injection is limited so as to prevent a sufficient increase in the combustion efficiency of the engine 11. As a result, an engine output that matches the load on the engine 11 cannot be attained, thus resulting in a lower rotational speed of the engine 11.

Therefore, when the shovel is at high altitudes (in an environment of relatively low atmospheric pressures), the controller 30 increases supercharging pressure before performance of a lever operation by executing the absorbed horsepower increasing operation.

Here, a description is given, also with reference to FIG. 6, of temporal transitions of various physical quantities at the time of executing the absorbed horsepower increasing operation when the shovel is at high altitudes (in an environment of relatively low atmospheric pressures). In FIG. 6, the temporal transitions of various physical quantities at the time of executing the absorbed horsepower increasing operation when the shovel is at high altitudes (in an environment of relatively low atmospheric pressures) are indicated by a solid line.

As the operator's lever operation, an operation of the arm operation lever is started to perform an excavating action at time t1 as described above. The amount of operation of the arm operation lever (an angle at which the operation lever is tilted) increases from time t1 to time t2, and at time t2, the amount of operation of the arm operation lever is fixed. That is, the arm operation lever is operated and tilted from time t1, and the tilt of the arm operation lever is fixed at time t2. When an operation of the arm operation lever is started at time t1, the arm 5 starts moving, and at time t2, the tilt of the arm operation lever is maximized.

In the case of executing the absorbed horsepower increasing operation, the controller 30 has adjusted the discharge quantity Q of the main pump 14 to the absorbed horsepower increase time flow rate Qs that is greater than the negative control flow rate Qn before time t1, that is, before performance of the lever operation. Therefore, such control as to maintain the engine rotational speed at a predetermined rotational speed works, so that the amount of fuel injection is increased compared with a state where the negative control is activated. As a result, supercharging pressure is relatively high the same as in the case where the shovel is at low altitudes (in an environment of relatively high atmospheric pressures). Furthermore, supercharging pressure is ready to increase immediately at time t2 at which the tilt of the arm operation lever is maximized.

Thus, by having applied a load on the engine 11 by adjusting the discharge quantity Q of the main pump 14 to the absorbed horsepower increase time flow rate Qs that is greater than the negative control flow rate Qn, it is possible to increase supercharging pressure immediately at time t2 at which the hydraulic load starts to increase.

After time t2, the hydraulic load increases to increase a load on the engine 11, so that an instruction to further increase the amount of fuel injection is issued to gradually increase the amount of fuel consumption. At this point, the amount of fuel consumption increases only by an amount corresponding to an increase in the hydraulic load. This is because the engine rotational speed has been maintained at a predetermined rotational speed so that there is no amount of fuel consumption necessary for increasing the engine rotational speed. Furthermore, at time t3, supercharging pressure has increased to a predetermined value or more, so that the engine 11 is ready to efficiently increase the engine output even when the hydraulic load increases.

Thus, by having applied a load on the engine 11 by adjusting the discharge quantity Q of the main pump 14 to the absorbed horsepower increase time flow rate Qs that is greater than the negative control flow rate Qn before performance of a lever operation, it is possible to start increasing supercharging pressure before a time at which a hydraulic load starts to increase.

As described above, in an environment of relatively high atmospheric pressures, supercharging pressure (see a broken line) is already relatively high at time t1 without execution of the absorbed horsepower increasing operation.

Therefore, the supercharging device 11*a* is ready to swiftly increase supercharging pressure without execution of the absorbed horsepower increasing operation. Furthermore, the engine 11 is ready to supply a driving force that matches a hydraulic load due to an external force without causing a decrease in the engine rotational speed (a decrease in workability) or an engine stall.

In an environment of relatively low atmospheric pressures, however, supercharging pressure (see a one-dot chain line) is relatively low even at time t2 without execution of the absorbed horsepower increasing operation. Furthermore, because of being in an environment of relatively low atmospheric pressures, the supercharging device 11*a* is prevented from swiftly increasing supercharging pressure. Specifically, according to this embodiment, the supercharging device 11*a* is prevented from attaining a sufficient supercharging pressure before time t3, so that the engine 11 is prevented from sufficiently increasing the amount of fuel injection.

As a result, the engine 11 is prevented from outputting a driving force to keep the engine rotational speed constant, and decreases the engine rotational speed (see a one-dot chain line). In some cases, the engine 11 fails to increase the engine rotational speed and goes on to stall.

Therefore, in an environment of relatively low atmospheric pressures, the controller 30 adjusts the discharge quantity Q of the main pump 14 to the absorbed horsepower increase time flow rate Os that is greater than the negative control flow rate Qn before time t1, that is, before performance of the lever operation, by executing the absorbed horsepower increasing operation. Therefore, a hydraulic load, which is the horsepower absorbed by the main pump 14, is relatively high, and supercharging pressure (see a solid line) as well is already relatively high at time t2.

As a result, even in an environment of relatively low atmospheric pressures, the supercharging device 11*a* is ready to swiftly increase supercharging pressure the same as in the case of an environment of relatively high atmospheric pressures. Furthermore, the engine 11 is ready to supply a driving force that matches a hydraulic load due to an external force without causing a decrease in the engine rotational speed (a decrease in workability) or an engine stall.

In this case, at time t2, when the arm 5 comes into contact with the ground, a hydraulic load increases in response to an increase in the excavation reaction force. Then, a load on the engine 11 also increases in response to this increase in the hydraulic load corresponding to the horsepower absorbed by the main pump 14. At this point, it is possible for the engine 11 to swiftly increase supercharging pressure with the supercharging device 11*a* in order to maintain a predetermined engine rotational speed.

Thus, in the case of relatively low atmospheric pressures, by having automatically increased a hydraulic load before performance of a lever operation, that is, by increasing an engine load before an increase in a hydraulic actuator load, it is possible for the controller 30 to maintain supercharging pressure at a relatively high level and to increase supercharging pressure without delay after performance of a lever operation. As a result, it is possible to prevent a decrease in the engine rotational speed or an engine stall at the time of performance of a lever operation.

Figure 7:
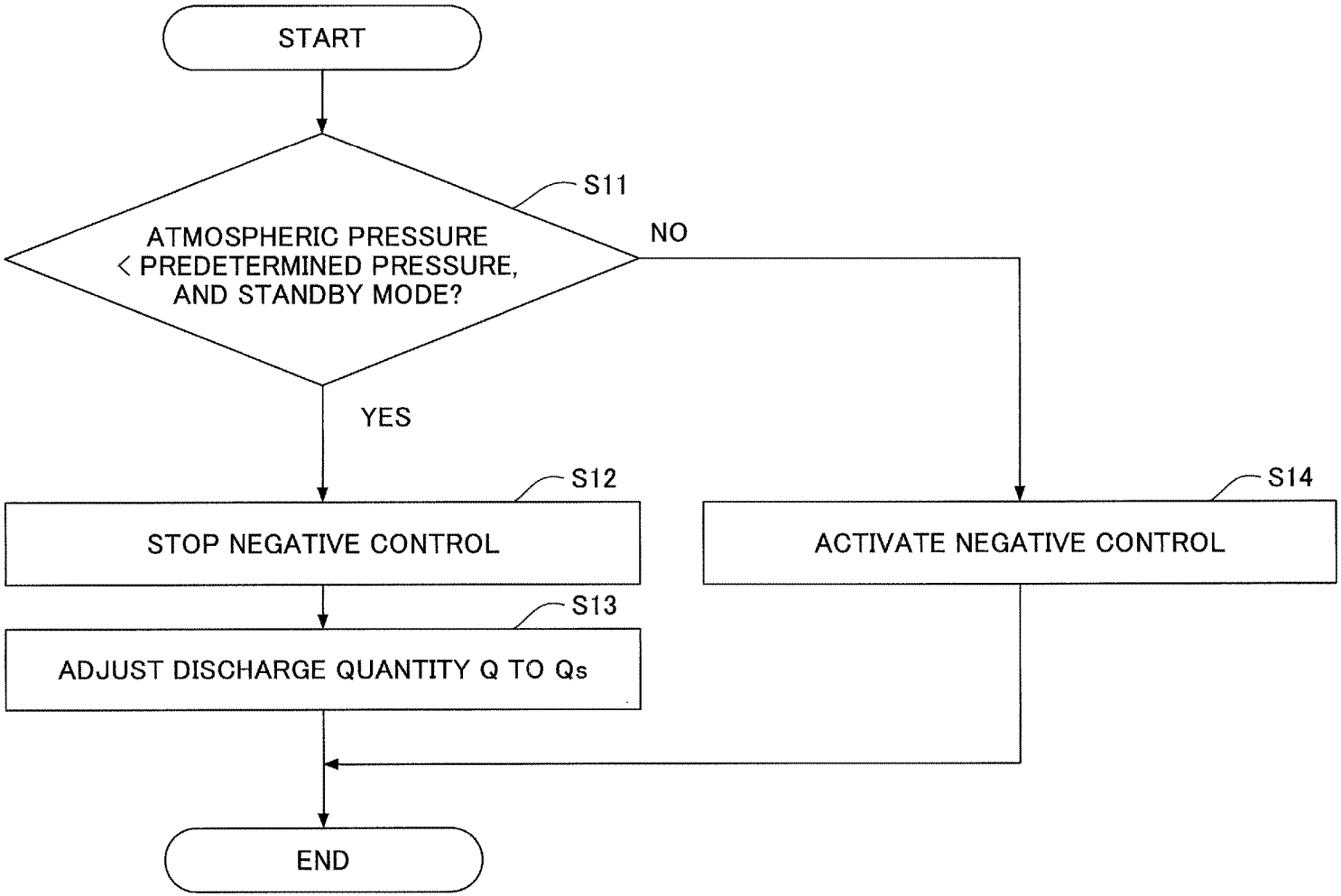
FIG. 7 is a flowchart illustrating a flow of another absorbed horsepower increasing operation.

Next, a description is given, with reference to FIG. 7, of another embodiment of the absorbed horsepower increasing operation. FIG. 7 is a flowchart illustrating a flow of the absorbed horsepower increasing operation according to this embodiment. According to the absorbed horsepower increasing operation of this embodiment, the condition of determination at step S11 is different from the condition of determination at step S1 of the absorbed horsepower increasing operation of FIG. 5, while steps S12 through S14 are equal to steps S2 through S4 of the absorbed horsepower increasing operation of FIG. 5. Therefore, a description is given in detail of step S11, and a description of the other steps is omitted. Furthermore, according to this embodiment, the switch 50 is omitted, and it is possible for the controller 30 to have the absorbed horsepower increase necessity/unnecessity determination part 300 and the absorbed horsepower control part (discharge quantity control part) 301 enabled at all times.

At step S11, the absorbed horsepower increase necessity/unnecessity determination part 300 determines whether the condition that the shovel is in the standby mode and the ambient atmospheric pressure of the shovel is less than a predetermined pressure is satisfied. According to this embodiment, the controller 30 determines whether the ambient atmospheric pressure of the shovel is less than a predetermined pressure based on the output of the atmospheric pressure sensor P1 mounted on the shovel.

If it is determined that the above-described condition is satisfied (YES at step S11), the controller 30 executes steps S12 and S13.

On the other hand, if it is determined that the above-described condition is not satisfied (NO at step S11), the controller 30 executes step S14.

This makes it possible for the controller 30 to achieve the same effects as in the case of the absorbed horsepower increasing operation of FIG. 5.

Furthermore, according to this embodiment in which the output of the atmospheric pressure sensor P1 is employed, the controller 30 may determine the size of the absorbed horsepower increase time flow rate Qs in accordance with the size of atmospheric pressure. In this case, the controller 30 may determine the size of the absorbed horsepower increase time flow rate Qs in accordance with the size of atmospheric pressure either stepwise or steplessly. This configuration makes it possible for the controller 30 to stepwise or steplessly control the size of the increased absorbed horsepower in the standby mode and further prevent unnecessary energy consumption.

Figure 8:
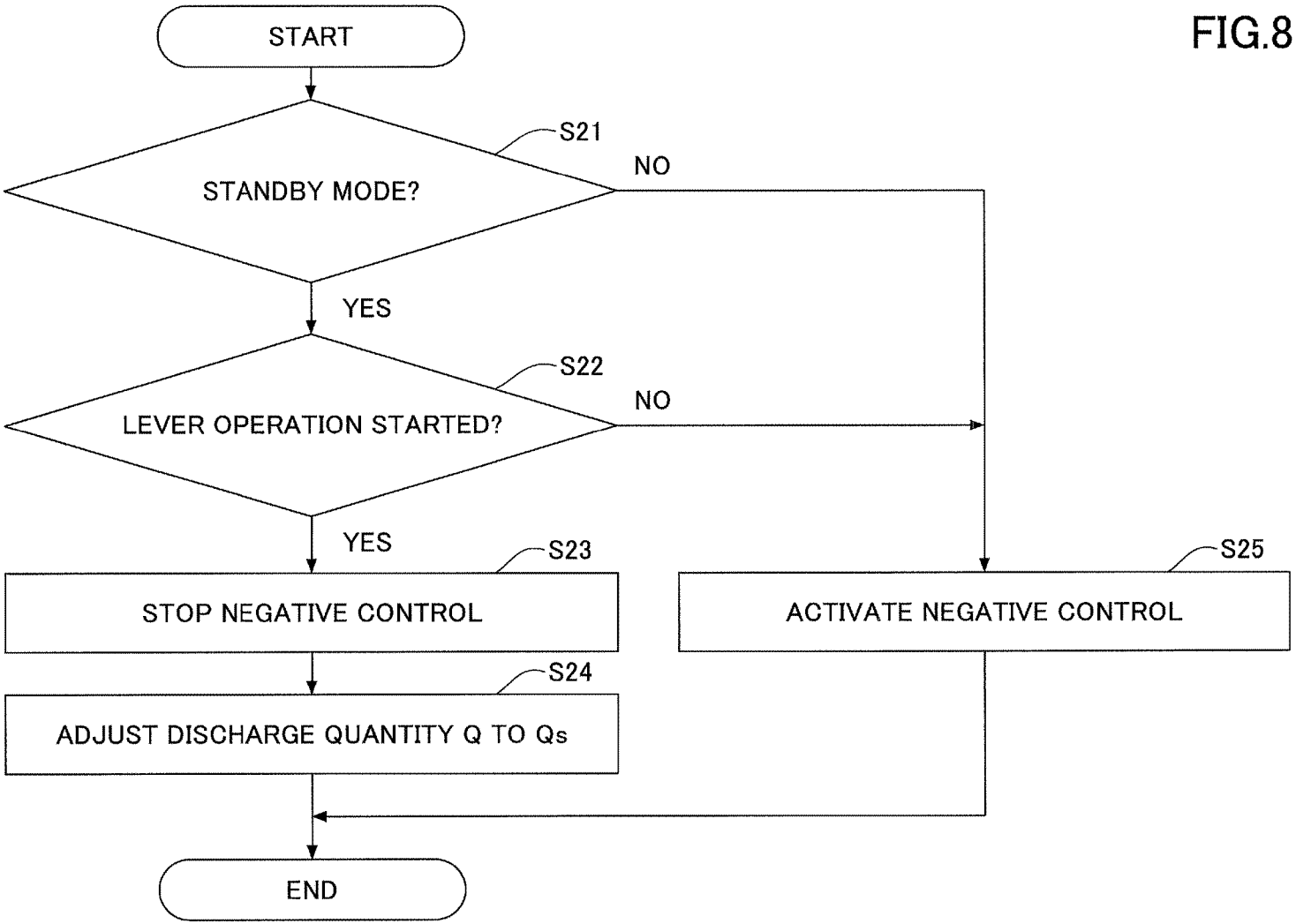
FIG. 8 is a flowchart illustrating a flow of yet another absorbed horsepower increasing operation.

Next, a description is given, with reference to FIG. 8, of yet another embodiment of the absorbed horsepower increasing operation. FIG. 8 is a flowchart illustrating a flow of the absorbed horsepower increasing operation according to this embodiment. According to the absorbed horsepower increasing operation of this embodiment, the horsepower absorbed by the main pump 14 is temporarily and automatically increased at the start of a lever operation regardless of the size of atmospheric pressure. Therefore, according to this embodiment, the switch 50 is omitted, and it is possible for the controller 30 to have the absorbed horsepower increase necessity/unnecessity determination part 300 and the absorbed horsepower control part (discharge quantity control part) 301 enabled at all times. Alternatively, it is also possible to cause the absorbed horsepower increasing operation according to this embodiment to function only in the case of relatively low atmospheric pressures using the switch 50 or the atmospheric pressure sensor P1.

First, the absorbed horsepower increase necessity/unnecessity determination part 300 of the controller 30 determines whether the shovel is in the standby mode (step S21). According to this embodiment, like in the absorbed horsepower increasing operation of FIG. 5, the absorbed horsepower increase necessity/unnecessity determination part 300 determines whether the shovel is in the standby mode based on whether or not the discharge pressure of the main pump 14 is a predetermined pressure or more.

If the absorbed horsepower increase necessity/unnecessity determination part 300 determines that the shovel is in the standby mode (there is no hydraulic load) (YES at step S21), the controller 30 determines whether a lever operation has been started (step S22). According to this embodiment, the controller 30 determines whether a lever operation has been started based on the output of the pressure sensor 29.

If it is determined that a lever operation has been started (YES at step S22), the controller 30 stops the negative control (step S23). Then, the controller 30 adjusts the discharge quantity Q of the main pump 14 to the absorbed horsepower increase time flow rate Qs that is greater than the negative control flow rate Qn (step S24).

On the other hand, if it is determined that a lever operation has not been started (NO at step S22), the controller 30 activates the negative control (step S25). This is for adjusting the discharge quantity Q of the main pump 14 to a flow rate corresponding to the negative control pressure within the range of the total horsepower control curve (see FIG. 4).

Furthermore, also in the case of the absorbed horsepower increase necessity/unnecessity determination part 300 determining that the shovel is not in the standby mode (there is a hydraulic load) (NO at step S21), for example, determining that the discharge pressure of the main pump 14 is a predetermined pressure or more, the controller 30 activates the negative control (step S25).

Alternatively, the absorbed horsepower increase necessity/unnecessity determination part 300 may determine whether the shovel is in the standby mode based on whether or not the discharge pressure of the main pump 14 is a predetermined pressure or more, whether a predetermined time has passed since the stoppage of the negative control, whether the negative control pressure is less than a predetermined pressure, or any of their combinations.

Thus, the controller 30 temporarily and automatically increases the horsepower absorbed by the main pump 14 when a lever operation is started. That is, an engine load is increased before a hydraulic actuator load increases. Therefore, by imposing a predetermined load on the engine 11, it is possible for the controller 30 to increase the supercharging pressure of the supercharging device 11*a* even when a hydraulic load due to an external force is not yet generated. That is, it is possible to increase supercharging pressure by a predetermined amount prior to a hydraulic load increase due to an external force without directly controlling the engine 11 and the supercharging device 11*a*. As a result, even in the case of a sudden hydraulic load increase due to an external force, it is possible for the supercharging device 11*a* to generate a supercharging pressure that matches a hydraulic load that increases in accordance with an external force before a decrease in the engine rotational speed (a decrease in workability) or an engine stall is caused. If an increase in supercharging pressure does not catch up with a hydraulic load (engine load) increase due to an external force, the engine 11 is prevented from sufficiently increasing the amount of fuel injection, thus decreasing the engine rotational speed. In some cases, the engine 11 fails to increase the engine rotational speed and goes on to stall.

Figure 9:
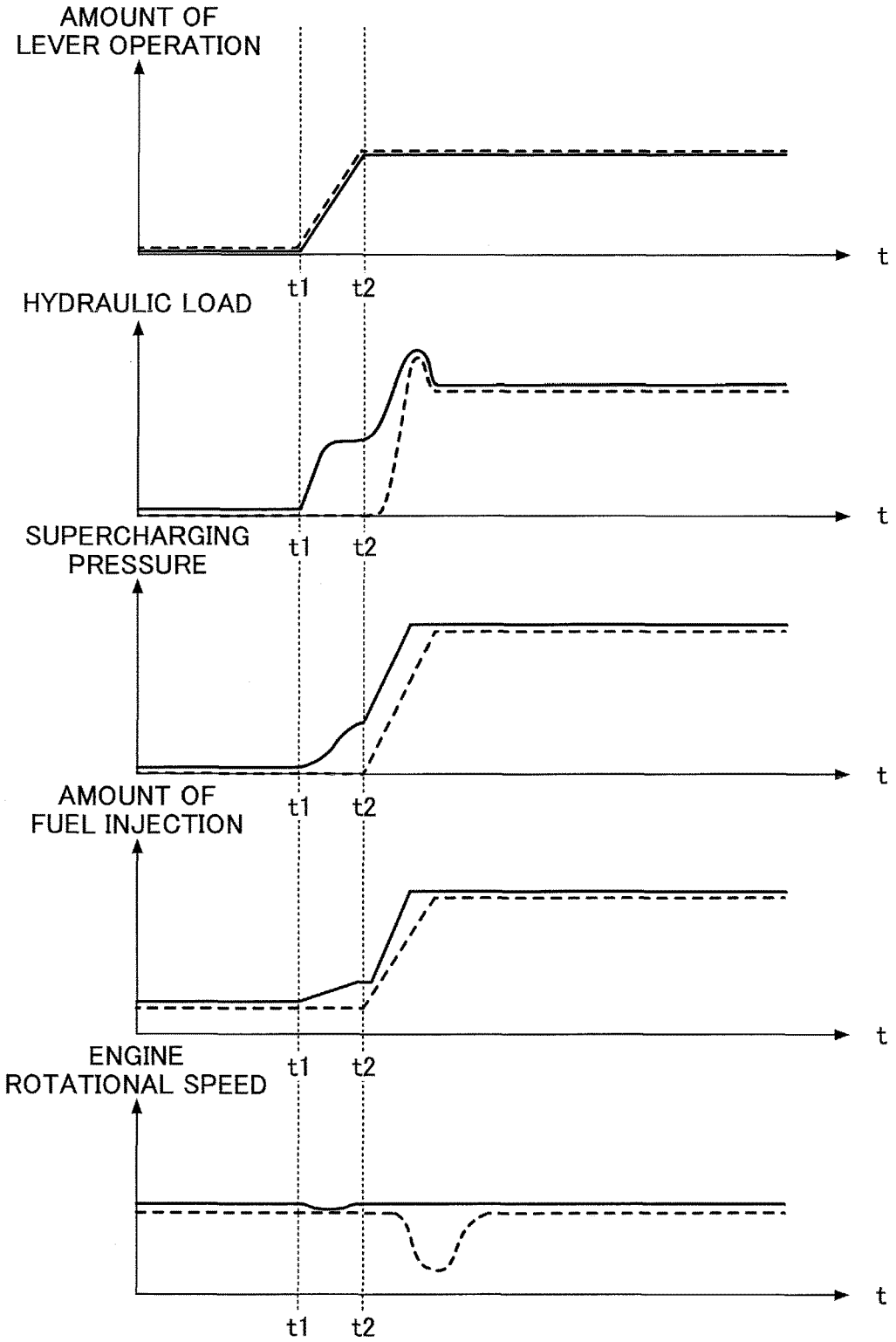
FIG. 9 is a chart illustrating temporal transitions of various physical quantities in the case of executing the absorbed horsepower increasing operation of FIG. 8.

Next, a description is given, with reference to FIG. 9, of temporal transitions of various physical quantities in the case of executing the absorbed horsepower increasing operation of FIG. 8. FIG. 9 is a chart illustrating temporal transitions of such various physical quantities, showing the respective temporal transitions of, in order from top to bottom, the amount of a lever operation, a hydraulic load (the horsepower absorbed by the main pump 14), supercharging pressure, the amount of fuel injection, and the engine rotational speed. Furthermore, the transitions indicated by a solid line in FIG. 9 indicate transitions in the case of executing the absorbed horsepower increasing operation of FIG. 8, and the transitions indicated by a broken line in FIG. 9 indicate transitions in the case of not executing the absorbed horsepower increasing operation of FIG. 8.

According to this embodiment, it is assumed that, for example, a lever operation for moving the arm 5 for excavation is started at time t1.

First, for comparison, a description is given of temporal transitions of various physical quantities in the case of not executing the absorbed horsepower increasing operation of FIG. 8. The temporal transition of the amount of a lever operation of the arm operation lever is the same as in the case of FIG. 6, and accordingly, its description is omitted.

In the case of not executing the absorbed horsepower increasing operation of FIG. 8, a hydraulic load (see a broken line) remains unincreased until time t2. Thereafter, at time t2, when the arm 5 comes into contact with the ground, a hydraulic load increases in response to an increase in the excavation reaction force.

Furthermore, supercharging pressure (see a broken line) as well remains unincreased until time t2, and is still relatively low at time t2. Therefore, the supercharging device 11*a* is prevented from causing an increase in supercharging pressure to follow an increase in the hydraulic load after time t2. As a result, the engine 11 is prevented from sufficiently increasing the amount of fuel injection so as to cause shortage of the engine output, thus failing to maintain and decreasing the engine rotational speed (see a broken line). In some cases, the engine 11 fails to increase the engine rotational speed and goes on to stall.

On the other hand, in the case of executing the absorbed horsepower increasing operation of FIG. 8, a hydraulic load (see a solid line) starts to increase at time t1 and increases to a predetermined level before time t2. That is, in response to detection of the start of an operation of the arm operation lever at time t1, the controller 30 controls the regulator 13 to increase the discharge flow rate of the main pump 14 for a predetermined time before a load is imposed on a hydraulic actuator. This predetermined time is a small amount of time sufficiently shorter than the time from time t1 to time t2 (for example, approximately less than 0.3 seconds). This makes it possible to increase the horsepower absorbed by the main pump 14 before the discharge pressure of the main pump 14 increases because of a load applied on the arm 5. Then, a load on the engine 11 as well increases in response to this increase in the hydraulic load corresponding to the horsepower absorbed by the main pump 14. At this point, the engine 11 increases supercharging pressure with the supercharging device 11*a* in order to maintain a predetermined engine rotational speed. Therefore, supercharging pressure (see a solid line) starts to increase at time t1, and increases to a predetermined level before time t2. Therefore, it is possible for the supercharging device 11*a* to increase supercharging pressure without lagging far behind a hydraulic load increase after time t2. As a result, it is possible for the engine 11 to maintain the engine rotational speed (see a solid line) without causing shortage of the engine output. Specifically, the engine rotational speed (see a solid line) is kept constant except for a slight decrease between time t1 and time t2 due to an automatic hydraulic load increase.

Thus, after the start of a lever operation, the controller 30 automatically increases a hydraulic load that is not due to an external force such as an excavation reaction force before a hydraulic load due to an external force increases. Then, by increasing an engine load by increasing the horsepower absorbed by the main pump 14, the controller 30 indirectly affects the supercharging device 11*a* of the engine 11 to increase supercharging pressure to a relatively high level. As a result, it is possible for the controller 30 to swiftly increase supercharging pressure that is already at a relatively high level even in the case of a sudden hydraulic load increase due to an external force such as an excavation reaction force. Furthermore, a decrease in the engine rotational speed (a decrease in workability), a stall of the engine 11, or the like is not caused at the time of increasing supercharging pressure.

Figure 10:
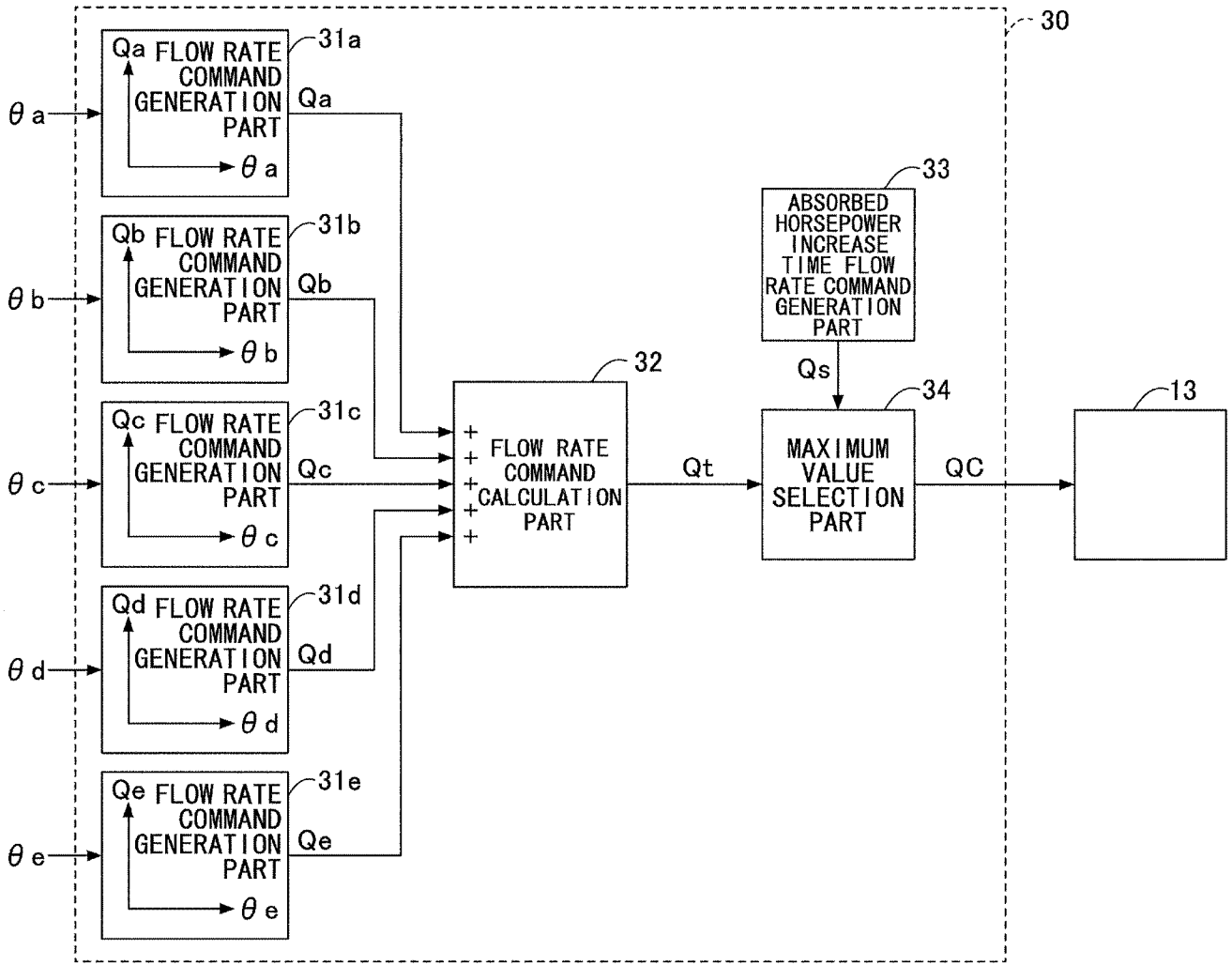
FIG. 10 is a functional block diagram of a controller installed in a shovel according to another embodiment of the present invention.

Next, a description is given, with reference to FIG. 10, of a shovel according to another embodiment of the present invention. A shovel according to this embodiment is different from the shovel according to the embodiment illustrated in FIGS. 1 through 9, which employs the negative control, in that positive control is employed. The positive control is control that calculates the total of the amounts of hydraulic oil per unit time that are respectively required to operate the hydraulic actuators and adjusts the discharge quantity of the main pump 14 to the total amount of hydraulic oil.

FIG. 10 is a functional block diagram of the controller 30 installed in a shovel according to this embodiment. The controller 30 controls the discharge quantity of the main pump 14 by outputting a flow rate command QC to the regulator 13.

According to this embodiment, the controller 30 mainly includes flow rate command generation parts 31*a* through 31*e*, a flow rate command calculation part 32, an absorbed horsepower increase time flow rate command generation part 33, and a maximum value selection part 34.

The flow rate command generation parts 31*a* through 31*e* are function elements that generate flow rate commands Qa through Qe corresponding to lever operation angles θa through θe serving as the amounts of a lever operation. According to this embodiment, each of the flow rate command generation parts 31*a* through 31*e* outputs a flow rate command corresponding to a lever operation angle, referring to a correspondence table that defines the relationship between the lever operation angle and the flow rate command, pre-recorded in a ROM or the like. The lever operation angles θa through θe correspond to a boom operation lever, an arm operation lever, a bucket operation lever, a turning operation lever, and a traveling lever, respectively. Furthermore, the amount of a lever operation may be based on a pilot pressure.

The flow rate command calculation part 32 is a function element that calculates a total flow rate command Qt by summing up the flow rate commands Qa through Qe output by the flow rate command generation parts 31*a* through 31*e*, respectively.

The absorbed horsepower increase time flow rate command generation part 33 is a function element that generates the absorbed horsepower increase time flow rate Qs used at the time of increasing the absorbed horsepower in the above-described absorbed horsepower increasing operation. According to this embodiment, the absorbed horsepower increase time flow rate command generation part 33 outputs the absorbed horsepower increase time flow rate Qs that is a value pre-recorded in a ROM or the like.

The maximum value selection part 34 is a function element that selects the larger of the total flow rate command Qt and the absorbed horsepower increase time flow rate Qs as the flow rate command QC, and outputs the selected flow rate command QC.

According to the above-described configuration, the controller 30 selects the total flow rate command Qt as the flow rate command QC when the absorbed horsepower increase necessity/unnecessity determination part 300 determines that there is no need to increase the horsepower absorbed by the main pump 14. On the other hand, the controller 30 selects the absorbed horsepower increase time flow rate Qs as the flow rate command QC when the absorbed horsepower increase necessity/unnecessity determination part 300 determines that there is a need to increase the horsepower absorbed by the main pump 14. Thus, it is possible for the controller 30 to increase the horsepower absorbed by the main pump 14 by automatically increasing the discharge quantity of the main pump 14 as required. As a result, it is possible for the controller 30 to achieve the same functions as the controller 30 according to the embodiment illustrated in FIGS. 1 through 9.

Figure 11:
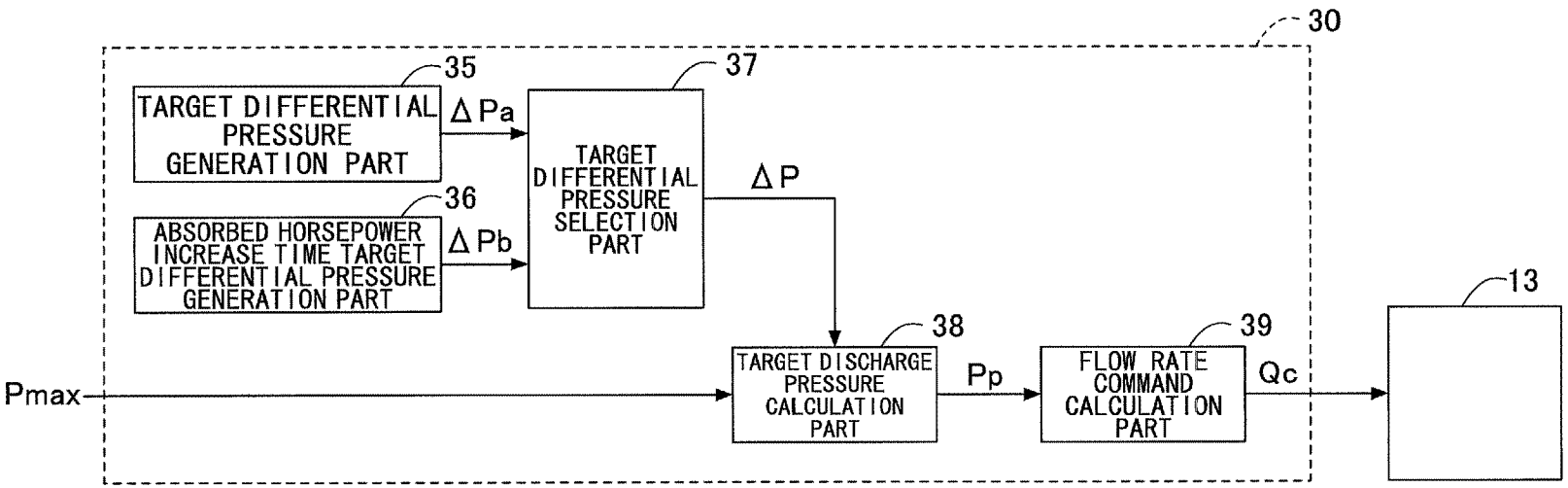
FIG. 11 is a functional block diagram of a controller installed in a shovel according to yet another embodiment of the present invention.

Next, a description is given, with reference to FIG. 11, of a shovel according to yet another embodiment of the present invention. A shovel according to this embodiment is different from the shovel according to the embodiment illustrated in FIGS. 1 through 9, which employs the negative control, and the shovel according to the embodiment illustrated in FIG. 10, which employs the positive control, in that load sensing control is employed. The load sensing control is control that adjusts the discharge quantity of the main pump 14 so that the discharge pressure of the main pump 14 is higher by a predetermined target differential pressure ΔP than a maximum load pressure Pmax (the largest one of the load pressures of the hydraulic actuators).

FIG. 11 is a functional block diagram of the controller 30 installed in a shovel according to this embodiment. The controller 30 controls the discharge quantity of the main pump 14 by outputting a flow rate command QC to the regulator 13.

According to this embodiment, the controller 30 mainly includes a target differential pressure generation part 35, an absorbed horsepower increase time target differential pressure generation part 36, a target differential pressure selection part 37, a target discharge pressure calculation part 38, and a flow rate command calculation part 39.

The target differential pressure generation part 35 is a function element that generates a normal time target differential pressure ΔPa. According to this embodiment, the target differential pressure generation part 35 outputs the normal time target differential pressure ΔPa that is a value pre-recorded in a ROM or the like.

The absorbed horsepower increase time target differential pressure generation part 36 is a function element that generates an absorbed horsepower increase time target differential pressure ΔPb that is used in the case of increasing the absorbed horsepower. The absorbed horsepower increase time target differential pressure ΔPb is a value greater than the normal time target differential pressure ΔPa. According to this embodiment, the absorbed horsepower increase time target differential pressure generation part 36 outputs the absorbed horsepower increase time target differential pressure ΔPb that is a value pre-recorded in a ROM or the like.

The target differential pressure selection part 37 is a function element that selects and outputs one of the normal time target differential pressure ΔPa and the absorbed horsepower increase time target differential pressure ΔPb as the target differential pressure ΔP. According to this embodiment, the target differential pressure selection part 37 selects the absorbed horsepower increase time target differential pressure ΔPb in the case of increasing the absorbed horsepower in the above-described absorbed horsepower increasing operation, and selects and outputs the normal time target differential pressure ΔPa in other cases.

The target discharge pressure calculation part 38 is a function element that calculates a target discharge pressure Pp by adding the target differential pressure ΔP to the maximum load pressure Pmax.

The flow rate command calculation part 39 is a function element that calculates the flow rate command QC based on the target discharge pressure Pp. According to this embodiment, the flow rate command calculation part 39 outputs the flow rate command QC corresponding to the target discharge pressure Pp, referring to a correspondence table that defines the relationship between the target discharge pressure Pp and the flow rate command QC, pre-recorded in a ROM or the like.

According to the above-described configuration, the controller 30 selects the normal time target differential pressure ΔPa (<ΔPb) as the target differential pressure ΔP when the absorbed horsepower increase necessity/unnecessity determination part 300 determines that there is no need to increase the horsepower absorbed by the main pump 14. On the other hand, the controller 30 selects the absorbed horsepower increase time target differential pressure ΔPb (>ΔPa) when the absorbed horsepower increase necessity/unnecessity determination part 300 determines that there is a need to increase the horsepower absorbed by the main pump 14. Thus, it is possible for the controller 30 to increase the horsepower absorbed by the main pump 14 by automatically increasing the discharge quantity of the main pump 14 as required. As a result, it is possible for the controller 30 to achieve the same functions as the controller 30 according to the embodiment illustrated in FIGS. 1 through 9 and the controller 30 according to the embodiment illustrated in FIG. 10.

Furthermore, the controller 30 may increase a load on the engine 11 by increasing the discharge quantity of another hydraulic pump connected to the engine 11.

Figure 12:
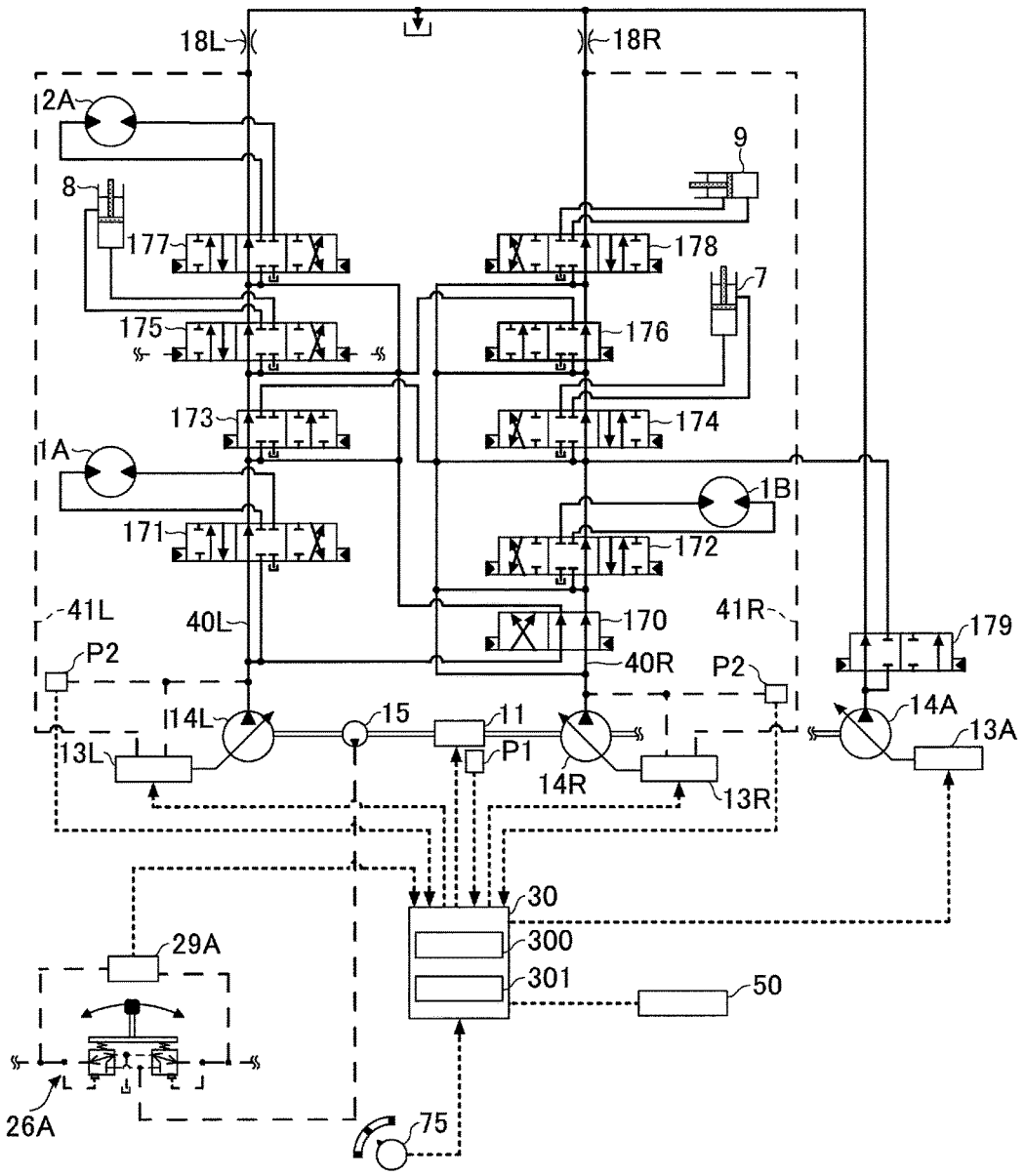
FIG. 12 is a schematic diagram illustrating another configuration of the hydraulic system.

Here, a description is given, with reference to FIG. 12, of a configuration in which a load on the engine 11 is varied using another hydraulic pump. FIG. 12 is a schematic diagram illustrating another configuration of the hydraulic system installed in the shovel of FIG. 1, and corresponds to FIG. 3.

The hydraulic system of FIG. 12 is different from the hydraulic system of FIG. 3 in including a main pump 14A, a regulator 13A, and a flow control valve 179, but is otherwise the same. Accordingly, a description of the same part is omitted, while differences are described in detail.

The main pump 14A is an apparatus that discharges hydraulic oil using the driving force of the engine 11, and is, for example, a swash-plate variable displacement hydraulic pump. According to this embodiment, like the main pumps 14L and 14R, the main pump 14A is a constituent element of the main pump 14, and its input shaft is connected to the output shaft of the engine 11. Furthermore, the main pump 14A has higher responsiveness than the main pumps 14L and 14R. According to this embodiment, the main pump 14A achieves higher responsiveness than the main pumps 14L and 14R by having a smaller maximum discharge quantity than the main pumps 14L and 14R. Specifically, the main pump 14A achieves higher responsiveness than the main pumps 14L and 14R because the main pump 14A is smaller in size and lower in inertia than the main pumps 14L and 14R. Alternatively, the main pump 14A may achieve high responsiveness with a property other than a maximum discharge quantity.

The regulator 13A is a device for controlling the discharge quantity of the main pump 14A. According to this embodiment, the regulator 13A controls the discharge quantity of the main pump 14A by adjusting the swash plate tilt angle of the main pump 14A in accordance with a control signal from the controller 30.

The flow control valve 179 is a spool valve that selects whether to supply hydraulic oil discharged by the main pump 14 to the boom cylinder 7 in normal control. According to this embodiment, the flow control valve 179 is disposed in the control valve 17. The flow control valve 179 operates to merge hydraulic oil discharged by the main pump 14A into hydraulic oil discharged by the main pump 14R on the upstream side of the flow control valve 174 when the boom operation lever 26A is operated for a predetermined amount of operation or more.

According to this embodiment, the controller 30 outputs a control signal to the regulator 13A so as to increase the discharge quantity of the main pump 14A for a predetermined time when the shovel is in the standby mode and it is determined that a lever operation is started.

This configuration makes it possible for the controller 30 to temporarily and automatically increase the horsepower absorbed by the main pump 14 before a load is applied on a hydraulic actuator. That is, it is possible to increase an engine load before a hydraulic actuator load increases. Furthermore, it is possible to increase an engine load more swiftly than in the case of stopping the negative control and adjusting the discharge quantity Q of the main pumps 14L and 14R to the absorbed horsepower increase time flow rate Qs. This is because the main pump 14A has higher responsiveness than the main pumps 14L and 14R so as to be able to more swiftly increase the discharge quantity to more swiftly increase the horsepower absorbed by the main pump 14A.

As a result, in addition to the effect in the case of executing the absorbed horsepower increasing operation of FIG. 8 using the hydraulic system of FIG. 3, the controller 30 achieves an additional effect that it is possible to more swiftly increase an engine load.

According to this embodiment, the controller 30 increases the discharge quantity of the main pump 14A, and also stops the negative control and adjusts the discharge quantity Q of the main pumps 14L and 14R to the absorbed horsepower increase time flow rate Qs. Alternatively, the controller 30 may omit stopping the negative control.

Furthermore, the controller 30 may also increase a load on the engine 11 by increasing the discharge pressure of the main pump 14.

Figure 13:
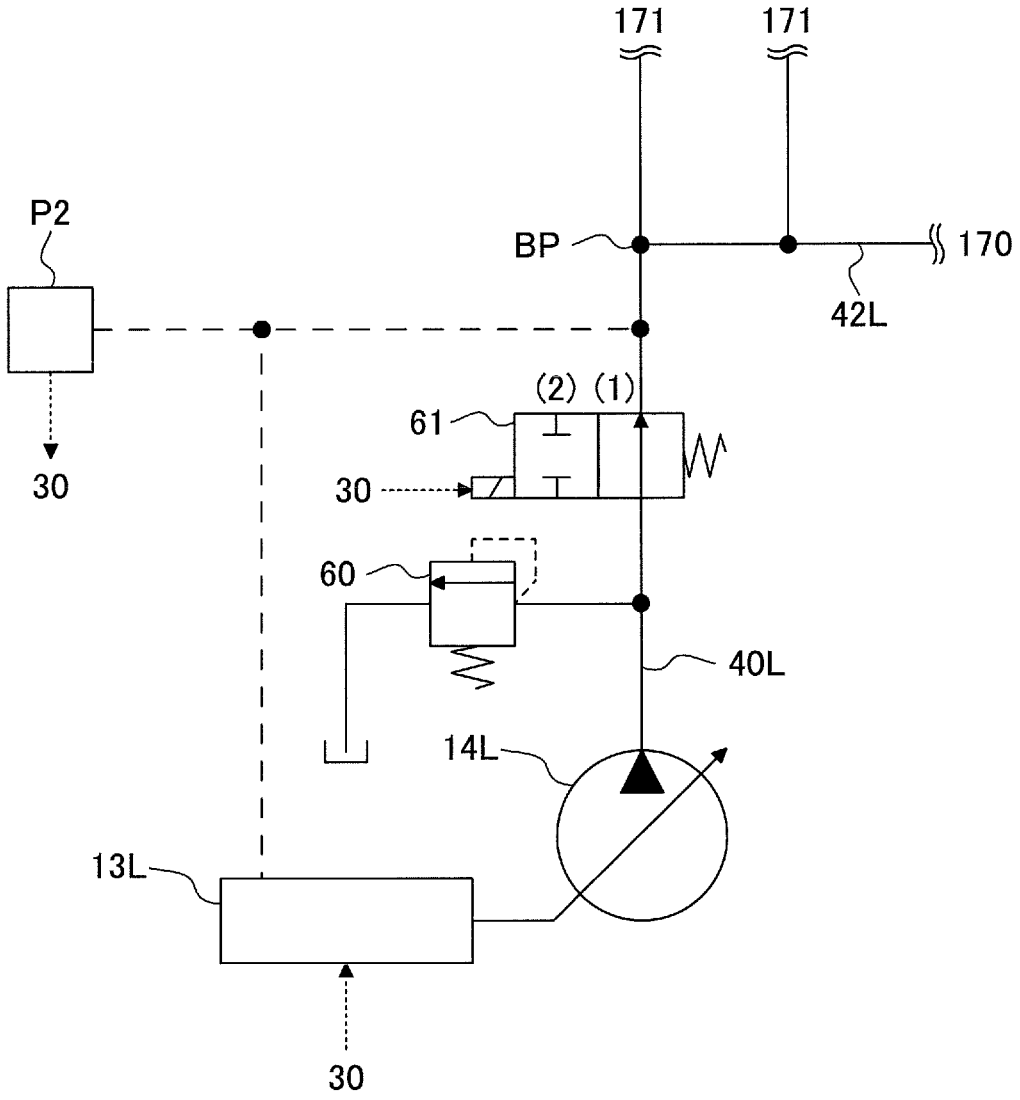
FIG. 13 is a schematic diagram illustrating yet another configuration of the hydraulic system.
Figure 14:
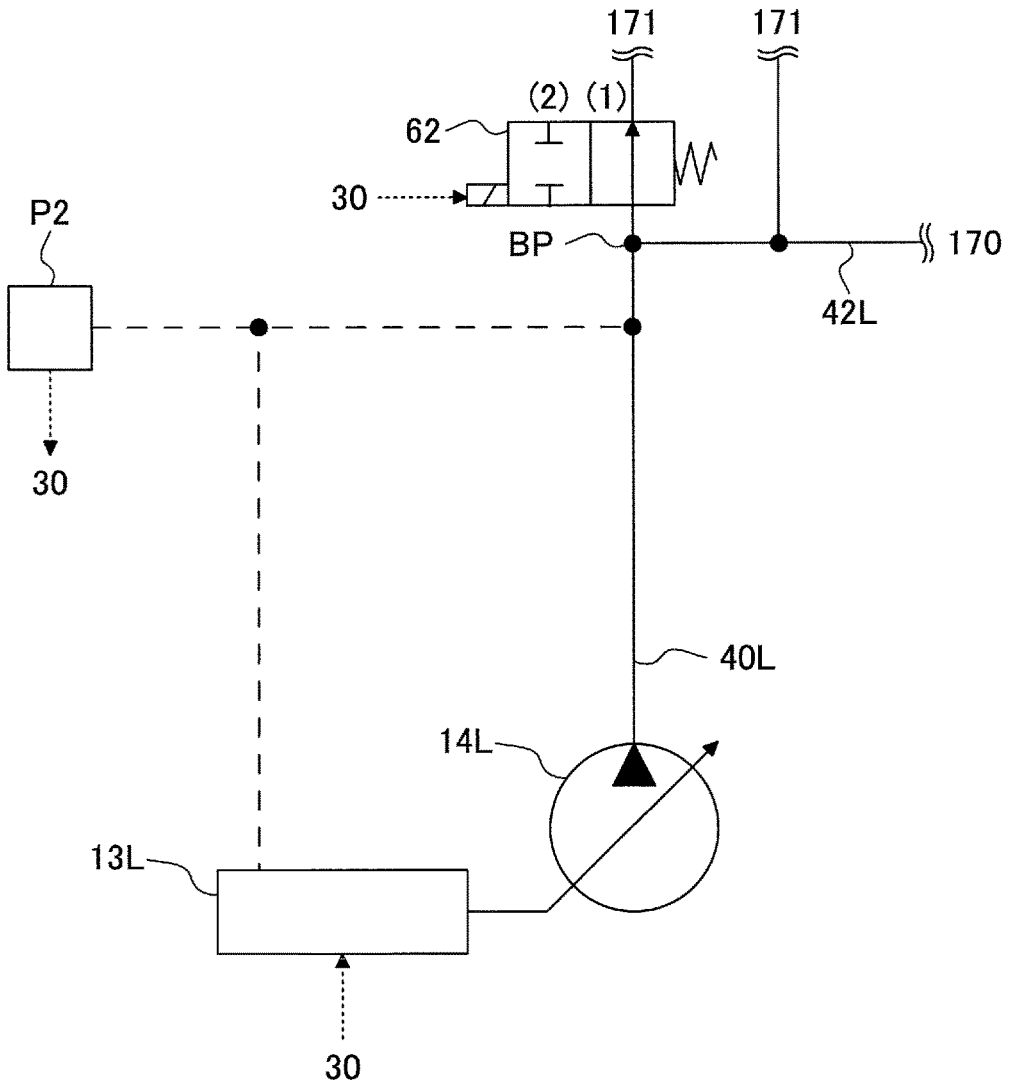
FIG. 14 is a schematic diagram illustrating yet another configuration of the hydraulic system.

Here, a description is given, with reference to FIGS. 13 and 14, of configurations of increasing a load on the engine 11 by increasing the discharge pressure of the main pump 14. Each of FIGS. 13 and 14 is a schematic diagram illustrating yet another configuration of the hydraulic system installed in the shovel of FIG. 1, and corresponds to an enlarged view of the main pump 14L of FIG. 3 and its surrounding. Furthermore, each of the configurations illustrated in FIGS. 13 and 14 is disposed on the discharge side of the main pump 14L, but may alternatively be disposed on the discharge side of the main pump 14R or on the discharge side of each of the main pumps 14L and 14R.

First, a description is given of the hydraulic system of FIG. 13. The hydraulic system of FIG. 13 is different from the hydraulic system of FIG. 3 in including a relief valve 60 and a selector valve 61 on the upstream side of a branch point BP of the center bypass conduit 40L and a bypass conduit 42L, but is otherwise the same. Accordingly, a description of the same part is omitted, while differences are described in detail.

The bypass conduit 42L is a high-pressure hydraulic line that passes through the flow control valve 170, which is a straight travel valve disposed in the control valve 17, and extends parallel to the center bypass conduit 40L.

The relief valve 60 is a valve for preventing the discharge pressure of the main pump 14L from exceeding a predetermined relief pressure. Specifically, the relief valve 60 discharges hydraulic oil on the discharge side of the main pump 14L to a hydraulic oil tank when the discharge pressure of the main pump 14L reaches a predetermined relief pressure.

The selector valve 61 is a valve that controls a flow of hydraulic oil from the main pump 14L to the flow control valves 170 and 171. According to this embodiment, the selector valve 61 is a two-port, two-position solenoid valve, and switches valve positions in accordance with a control command from the controller 30. Alternatively, the selector valve 61 may be a proportional valve that operates with a pilot pressure. Specifically, the selector valve 61 has a first position and a second position as valve positions. The first position is a valve position that causes the main pump 14L to communicate with the flow control valves 170 and 171. Furthermore, the second position is a valve position that interrupts the communication between the main pump 14L and the flow control valves 170 and 171. The parenthesized numbers in the drawing indicate the numbers of the valve positions. The same is the case with other selector valves.

The controller 30 outputs a control command to the selector valve 61 and holds the valve position of the selector valve 61 switched from the first position to the second position for a predetermined time when the shovel is in the standby mode and the controller 30 determines that a lever operation has been started. As a result, the discharge pressure of the main pump 14L rises to a predetermined relief pressure. When the discharge pressure of the main pump 14L reaches the predetermined relief pressure, the relief valve 60 opens so as to discharge hydraulic oil on the discharge side of the main pump 14L to the hydraulic oil tank.

This configuration makes it possible for the controller 30 to temporarily and automatically increase the horsepower absorbed by the main pump 14 that is expressed by the product of the discharge pressure and the discharge quantity before a load is applied to a hydraulic actuator. That is, it is possible to increase an engine load before a hydraulic actuator load increases. As a result, it is possible for the controller 30 to achieve the same effect as in the case of executing the absorbed horsepower increasing operation of FIG. 8 using the hydraulic system of FIG. 3, that is, the same effect as in the case of temporarily and automatically increasing the horsepower absorbed by the main pump 14 by increasing the discharge quantity of the main pump 14.

Next, a description is given of the hydraulic system of FIG. 14. The hydraulic system of FIG. 14 is different from the hydraulic system of FIG. 3 in including a selector valve 62 on the downstream side of the branch point BP of the center bypass conduit 40L and the bypass conduit 42L, but is otherwise the same. Accordingly, a description of the same part is omitted, while differences are described in detail.

The selector valve 62 is a valve that controls a flow of hydraulic oil from the main pump 14L to the flow control valve 171. According to this embodiment, the selector valve 62 is a two-port, two-position solenoid valve, and switches valve positions in accordance with a control command from the controller 30. Alternatively, the selector valve 62 may be a proportional valve that operates with a pilot pressure. Specifically, the selector valve 62 has a first position and a second position as valve positions. The first position is a valve position that causes the main pump 14L to communicate with the PT port of the flow control valve 171. Furthermore, the second position is a valve position that interrupts the communication between the main pump 14L and the PT port of the flow control valve 171.

The controller 30 outputs a control command to the selector valve 62 and holds the valve position of the selector valve 62 switched from the first position to the second position for a predetermined time when the shovel is in the standby mode and the controller 30 determines that a lever operation has been started. As a result, the communication between the main pump 14L and the PT port of the flow control valve 171 is interrupted, so that hydraulic oil discharged by the main pump 14L flows into the bypass conduit 42L. According to this embodiment, the pipe diameter of the bypass conduit 42L is smaller than the pipe diameter of the center bypass diameter 40L. Therefore, the discharge pressure of the main pump 14L increases.

This configuration makes it possible for the controller 30 to temporarily and automatically increase the horsepower absorbed by the main pump 14 that is expressed by the product of the discharge pressure and the discharge quantity before a load is applied to a hydraulic actuator. That is, it is possible to increase an engine load before a hydraulic actuator load increases. As a result, it is possible for the controller 30 to achieve the same effect as in the case of executing the absorbed horsepower increasing operation of FIG. 8 using the hydraulic system of FIG. 3, that is, the same effect as in the case of temporarily and automatically increasing the horsepower absorbed by the main pump 14 by increasing the discharge quantity of the main pump 14.

Figure 15:
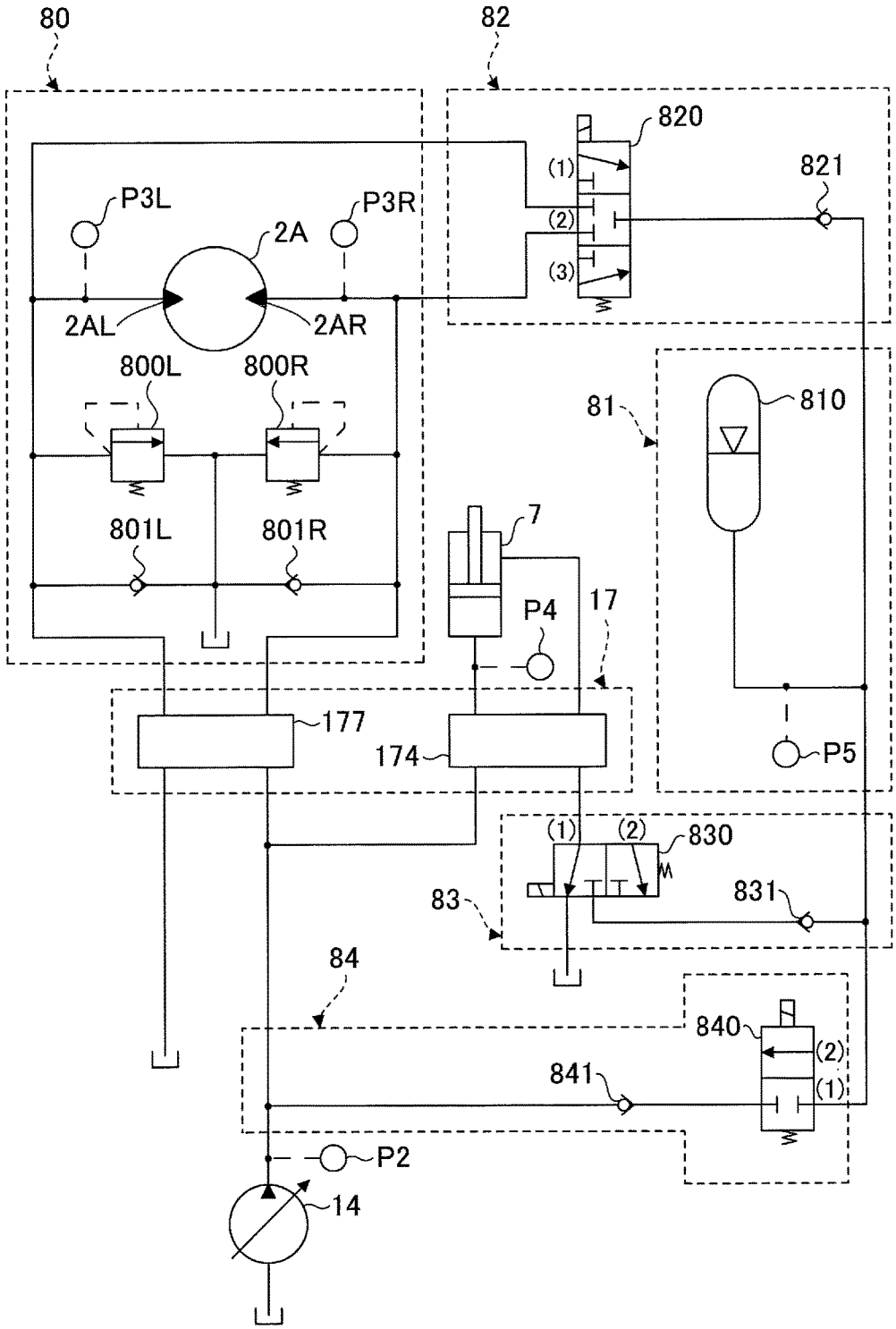
FIG. 15 is a schematic diagram illustrating yet another configuration of the hydraulic system.

Next, a description is given, with reference to FIG. 15, of yet another configuration of increasing a load on the engine 11 by increasing the discharge pressure of the main pump 14. FIG. 15 is a schematic diagram illustrating part of yet another configuration of the hydraulic system installed in the shovel of FIG. 1.

The system illustrated in FIG. 15 mainly includes a turning control part 80, an accumulator part 81, a first pressure storage part 82, a second pressure storage part 83, and a pressure discharge part 84.

The turning control part 80 mainly includes the turning hydraulic motor 2A, relief valves 800L and 800R, and check valves 801L and 801R.

The relief valve 800L is a valve for preventing the pressure of hydraulic oil on the first port 2AL side of the turning hydraulic motor 2A from exceeding a predetermined turning relief pressure. Specifically, when the pressure of hydraulic oil on the first port 2AL side reaches a predetermined relief pressure, the hydraulic oil on the first port 2AL side is discharged to a hydraulic oil tank.

Likewise, the relief valve 800R is a valve for preventing the pressure of hydraulic oil on the second port 2AR side of the turning hydraulic motor 2A from exceeding a predetermined turning relief pressure. Specifically, when the pressure of hydraulic oil on the second port 2AR side reaches a predetermined relief pressure, the hydraulic oil on the second port 2AR side is discharged to the hydraulic oil tank.

The check valve 801L is a valve for preventing the pressure of hydraulic oil on the first port 2AL side from falling below a hydraulic oil tank pressure. Specifically, when the pressure of hydraulic oil on the first port 2AL side decreases to a hydraulic oil tank pressure, hydraulic oil in the hydraulic oil tank is supplied to the first port 2AL side.

Likewise, the check valve 801R is a valve for preventing the pressure of hydraulic oil on the second port 2AR side from falling below a hydraulic oil tank pressure. Specifically, when the pressure of hydraulic oil on the second port 2AR side decreases to a hydraulic oil tank pressure, hydraulic oil in the hydraulic oil tank is supplied to the second port 2AR side.

The accumulator part 81 is a function element that stores hydraulic oil in the hydraulic system and discharges the stored hydraulic oil as required. Specifically, the accumulator part 81 stores hydraulic oil on the braking side (discharge side) of the turning hydraulic motor 2A during turning speed reduction. Furthermore, the accumulator part 81 stores hydraulic oil that the boom cylinder 7 discharges during a boom lowering operation. The accumulator part 81 discharges the stored hydraulic oil to the downstream side (discharge side) of the main pump 14R when, for example, a hydraulic actuator is operated.

According to this embodiment, the accumulator part 81 mainly includes an accumulator 810. The accumulator 810 is a device that stores hydraulic oil in the hydraulic system and discharges the stored hydraulic oil as required. According to this embodiment, the accumulator 810 is a spring accumulator that uses the restoring force of a spring.

The first pressure storage part 82 is a function element that controls a flow of hydraulic oil between the turning control part 80 (the turning hydraulic motor 2A) and the accumulator part 81. According to this embodiment, the first pressure storage part 82 mainly includes a first selector valve 820 and a first check valve 821.

The first selector valve 820 is a valve that controls a flow of hydraulic oil from the turning control part 80 to the accumulator part 81 at the time of the pressure storing (regenerative) operation of the accumulator part 81. According to this embodiment, the first selector valve 820 is a three-port, three-position solenoid valve, and switches valve positions in accordance with a control command from the controller 30. Alternatively, the first selector valve 820 may be a proportional valve that operates with a pilot pressure. Specifically, the first selector valve 820 has a first position, a second position, and a third position as valve positions.

The first position is a valve position that causes the first port 2AL to communicate with the accumulator part 81. The second position is a valve position that interrupts the communication between the turning control part 80 and the accumulator part 81. The third position is a valve position that causes the second port 2AR to communicate with the accumulator part 81.

The first check valve 821 is a valve that prevents hydraulic oil from flowing from the accumulator part 81 to the turning control part 80.

The second pressure storage part 83 is a function element that controls a flow of hydraulic oil between the control valve 17 and the accumulator part 81. According to this embodiment, the second pressure storage part 83 is disposed among the flow control valve 174 corresponding to the boom cylinder 7, the hydraulic oil tank, and the accumulator part 81, and mainly includes a second selector valve 830 and a second check valve 831. The flow control valve 174 may be one or more of the other flow control valves such as the flow control valve 175 corresponding to the arm cylinder 8.

The second selector valve 830 is a valve that controls a flow of hydraulic oil from a hydraulic actuator to the accumulator part 81 at the time of the pressure storing (regenerative) operation of the accumulator part 81. According to this embodiment, the second selector valve 830 is a three-port, two-position solenoid valve, and switches valve positions in accordance with a control command from the controller 30. Alternatively, the second selector valve 830 may be a proportional valve that operates with a pilot pressure. Specifically, the second selector valve 830 has a first position and a second position as valve positions. The first position is a valve position that causes the CT port of the flow control valve 174 to communicate with the hydraulic oil tank and interrupts the communication between the CT port of the flow control valve 174 and the accumulator part 81. The second position is a valve position that causes the CT port of the flow control valve 174 to communicate with the accumulator part 81 and interrupts the communication between the CT port of the flow control valve 174 and the hydraulic oil tank.

The second check valve 831 is a valve that prevents hydraulic oil from flowing from the accumulator part 81 to the second selector valve 830.

The pressure discharge part 84 is a function element that controls a flow of hydraulic oil among the main pump 14, the control valve 17, and the accumulator part 81. According to this embodiment, the pressure discharge part 84 mainly includes a third selector valve 840 and a third check valve 841.

The third selector valve 840 is a valve that controls a flow of hydraulic oil from the accumulator part 81 to a junction on the downstream side of the main pump 14 at the time of the pressure discharge (power running) operation of the accumulator part 81. According to this embodiment, the third selector valve 840 is a two-port, two-position solenoid valve, and switches valve positions in accordance with a control command from the controller 30. Alternatively, the third selector valve 840 may be a proportional valve that operates with a pilot pressure. Specifically, the third selector valve 840 has a first position and a second position as valve positions. The first position is a valve position that interrupts the communication between the junction on the downstream side of the main pump 14 and the accumulator part 81. Furthermore, the second position is a valve position that causes the junction on the downstream side of the main pump 14 to communicate with the accumulator part 81.

The third check valve 841 is a valve that prevents hydraulic oil from flowing from the main pump 14 to the accumulator part 81.

Figure 16:
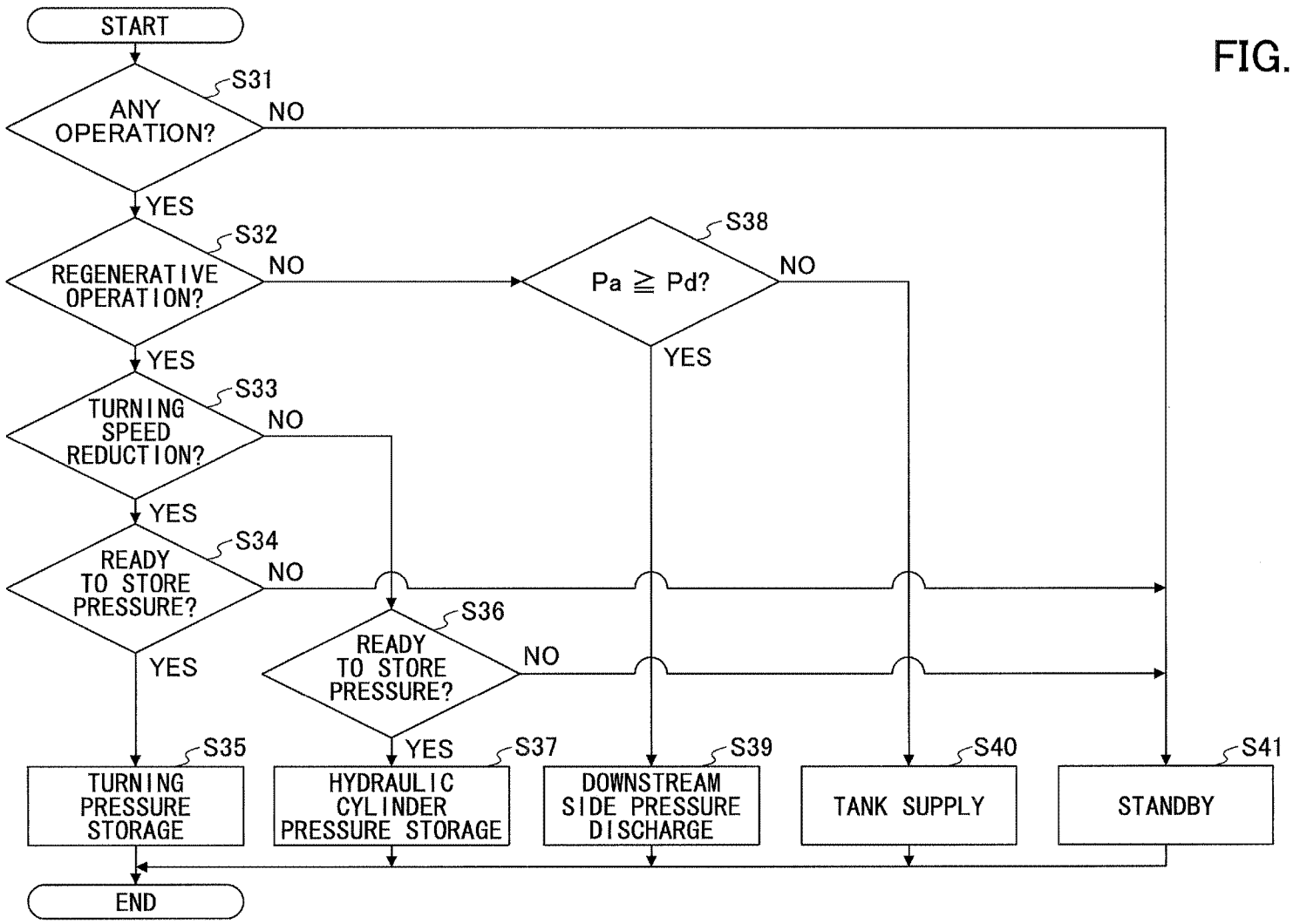
FIG. 16 is a flowchart illustrating a flow of a pressure storing and pressure discharge operation.

Here, a description is given, with reference to FIG. 16, of the controller 30's operation of controlling pressure storing and pressure discharge by the accumulator part 81 in normal control (hereinafter, "pressure storing and pressure discharge operation"). FIG. 16 is a flowchart illustrating a flow of the pressure storing and pressure discharge operation, and the controller 30 repeatedly executes this pressure storing and pressure discharge operation at predetermined intervals.

First, the controller 30 determines whether a hydraulic actuator has been operated based on the outputs of various sensors for detecting the condition of the shovel (step S31). According to this embodiment, the controller 30 determines whether a hydraulic actuator has been operated based on the outputs of the pressure sensor 29.

If it is determined that a hydraulic actuator has been operated (YES at step S31), the controller 30 determines whether the operation is a regenerative operation or a power running operation (step S32). According to this embodiment, the controller 30 determines, based on the outputs of the pressure sensor 29, whether a regenerative operation such as a turning speed reduction operation or a boom lowering operation has been performed or a power running operation such as a turning speed increasing operation or a boom raising operation has been performed.

If it is determined that a regenerative operation has been performed (YES at step S32), the controller 30 determines whether the regenerative operation is a turning speed reduction operation or a regenerative operation other than that (step S33).

If it is determined that the regenerative operation is a turning speed reduction operation (YES at step S33), the controller 30 determines whether the accumulator part 81 is ready to store pressure (step S34). According to this embodiment, the controller 30 determines whether the accumulator part 81 is ready to store pressure based on a pressure Pso on the braking side (discharge side) of the turning hydraulic motor 2A, output by a pressure sensor P3L or a pressure sensor P3R, and an accumulator pressure Pa output by a pressure sensor P5. Specifically, the controller 30 determines that the accumulator part 81 is ready to store pressure if the pressure Pso exceeds the accumulator pressure Pa, and determines that the accumulator part 81 is not ready to store pressure if the pressure Pso is less than or equal to the accumulator pressure Pa.

In response to determining that the accumulator part 81 is ready to store pressure (YES at step S34), the controller 30 sets the state of the hydraulic system to a state of "turning pressure storage" (step S35).

Specifically, in the "turning pressure storage" state, the controller 30 sets the first selector valve 820 to the first position or third position so as to cause the turning control part 80 to communicate with the accumulator part 81 via the first pressure storage part 82. Furthermore, the controller 30 sets the second selector valve 830 to the first position so as to cause the CT port of the flow control valve 174 to communicate with the hydraulic oil tank and interrupt the communication between the CT port of the flow control valve 174 and the accumulator part 81. Furthermore, the controller 30 sets the third selector valve 840 to the first position so as to interrupt the communication between the junction on the downstream side of the main pump 14 and the accumulator part 81.

As a result, in the "turning pressure storage" state, hydraulic oil on the braking side of the turning hydraulic motor 2A flows to the accumulator part 81 via the first pressure storage part 82 so as to be stored in the accumulator 810. Furthermore, because each of the second selector valve 830 and the third selector valve 840 is closed relative to the accumulator part 81, hydraulic oil on the braking side of the turning hydraulic motor 2A is prevented from flowing into locations other than the accumulator part 81.

Furthermore, in response to determining at step S33 that the regenerative operation is a regenerative operation other than the turning speed reduction operation (NO at step S33), the controller 30 determines whether the accumulator part 81 is ready to store pressure (step S36). According to this embodiment, the controller 30 determines whether the accumulator part 81 is ready to store pressure based on a pressure Pbb of the bottom-side oil chamber of the boom cylinder 7, output by a pressure sensor P4, and the accumulator pressure Pa output by the pressure sensor P5. Specifically, the controller 30 determines that the accumulator part 81 is ready to store pressure if the pressure Pbb exceeds the accumulator pressure Pa, and determines that the accumulator part 81 is not ready to store pressure if the pressure Pbb is less than or equal to the accumulator pressure Pa.

In response to determining that the accumulator part 81 is ready to store pressure (YES at step S36), the controller 30 sets the state of the hydraulic system to a state of "hydraulic cylinder pressure storage" (step S37). According to this embodiment, the controller 30 sets the state of the hydraulic system to the "hydraulic cylinder pressure storage" state in response to determining that the regenerative operation is a boom lowering operation.

Specifically, in the "hydraulic cylinder pressure storage" state, the controller 30 sets the first selector valve 820 to the second position so as to interrupt the communication between the turning control part 80 and the accumulator part 81 via the first pressure storage part 82. Furthermore, the controller 30 sets the second selector valve 830 to the second position so as to cause the CT port of the flow control valve 174 to communicate with the accumulator part 81 and interrupt the communication between the CT port of the flow control valve 174 and the hydraulic oil tank. A description of the state of the third selector valve 840, which is the same as the state at the time of "turning pressure storage," is omitted.

As a result, in the "hydraulic cylinder pressure storage" state, the bottom-side hydraulic oil of the boom cylinder 7 flows to the accumulator part 81 via the second pressure storage part 83 so as to be stored in the accumulator 810. Furthermore, because each of the first selector valve 820 and the third selector valve 840 is closed relative to the accumulator part 81, the bottom-side hydraulic oil of the boom cylinder 7 is prevented from flowing into locations other than the accumulator part 81.

Furthermore, in response to determining at step S32 that the operation is not a regenerative operation but a power running operation (NO at step S32), the controller 30 determines whether the accumulator pressure Pa is more than or equal to a discharge pressure Pd that is the output of the discharge pressure sensor P2 (step S38). According to this embodiment, the controller 30 determines whether the accumulator pressure Pa is less than the discharge pressure Pd based on the output of the pressure sensor P5.

In response to determining that the accumulator pressure Pa is more than or equal to the discharge pressure Pd (YES at step S38), the controller 30 sets the state of the hydraulic system to a state of "downstream side pressure discharge" (step S39).

Specifically, in the "downstream side pressure discharge" state, the controller 30 sets the first selector valve 820 to the second position so as to interrupt the communication between the turning control part 80 and the accumulator part 81 via the first pressure storage part 82. Furthermore, the controller 30 sets the second selector valve 830 to the first position so as to cause the CT port of the flow control valve 174 to communicate with the hydraulic oil tank and interrupt the communication between the CT port of the flow control valve 174 and the accumulator part 81. Furthermore, the controller 30 sets the third selector valve 840 to the second position so as to cause the junction on the downstream side of the main pump 14 to communicate with the accumulator part 81.

As a result, in the "downstream side pressure discharge" state, hydraulic oil in the accumulator part 81 is discharged at the junction on the downstream side of the main pump 14 through the pressure discharge part 84. Furthermore, because each of the first selector valve 820 and the second selector valve 830 is closed relative to the accumulator part 81, hydraulic oil in the accumulator part 81 is prevented from being discharged at locations other than the junction on the downstream side of the main pump 14.

Furthermore, in response to determining at step S38 that the accumulator pressure Pa is less than the discharge pressure Pd (NO at step S38), the controller 30 sets the state of the hydraulic system to a state of "tank supply" (step S40), and prevents hydraulic oil from being discharged from the accumulator part 81.

Specifically, in the "tank supply" state, the controller 30 sets the third selector valve 840 to the first position so as to interrupt the communication between the junction on the downstream side of the main pump 14 and the accumulator part 81. A description of the states of the first selector valve 820 and the second selector valve 830, which are the same as the states at the time of "downstream side pressure discharge," is omitted.

As a result, in the "tank supply" state, the main pump 14 supplies hydraulic oil drawn in from the hydraulic oil tank to a hydraulic actuator in operation. Furthermore, because each of the first selector valve 820, the second selector valve 830, and the third selector valve 840 is closed relative to the accumulator part 81, no hydraulic oil is stored in or discharged from the accumulator part 81. The first selector valve 820 and the second selector valve 830, however, may be switched so as to allow the accumulator part 81 to store hydraulic oil.

Furthermore, in response to determining at step S31 that no hydraulic actuator is operated (NO at step S31), the controller 30 sets the state of the hydraulic system to a state of "standby" (step S41).

Specifically, in the "standby" state, the states of the first selector valve 820, the second selector valve 830, and the third selector valve 840 are the same as the states at the time of "tank supply." As a result, in the "standby" state, no hydraulic oil is stored in or discharged from the accumulator part 81.

Furthermore, also in response to determining at step S34 that the accumulator part 81 is not ready to store pressure (NO at step S34), the controller 30 sets the state of the hydraulic system to the "standby" state (step S41). In this case, because the first selector valve 820 is at the second position, hydraulic oil on the braking side (discharge side) of the turning hydraulic motor 2A is discharged to the hydraulic oil tank via the relief valve 800L or the relief valve 800R.

Furthermore, also in response to determining at step S36 that the accumulator part 81 is not ready to store pressure (NO at step S36), the controller 30 sets the state of the hydraulic system to the "standby" state (step S41). In this case, because the second selector valve 830 is at the first position, hydraulic oil in the bottom-side oil chamber of the boom cylinder 7 is discharged to the hydraulic oil tank via the flow control valve 174 and the second selector valve 830.

Figure 17:
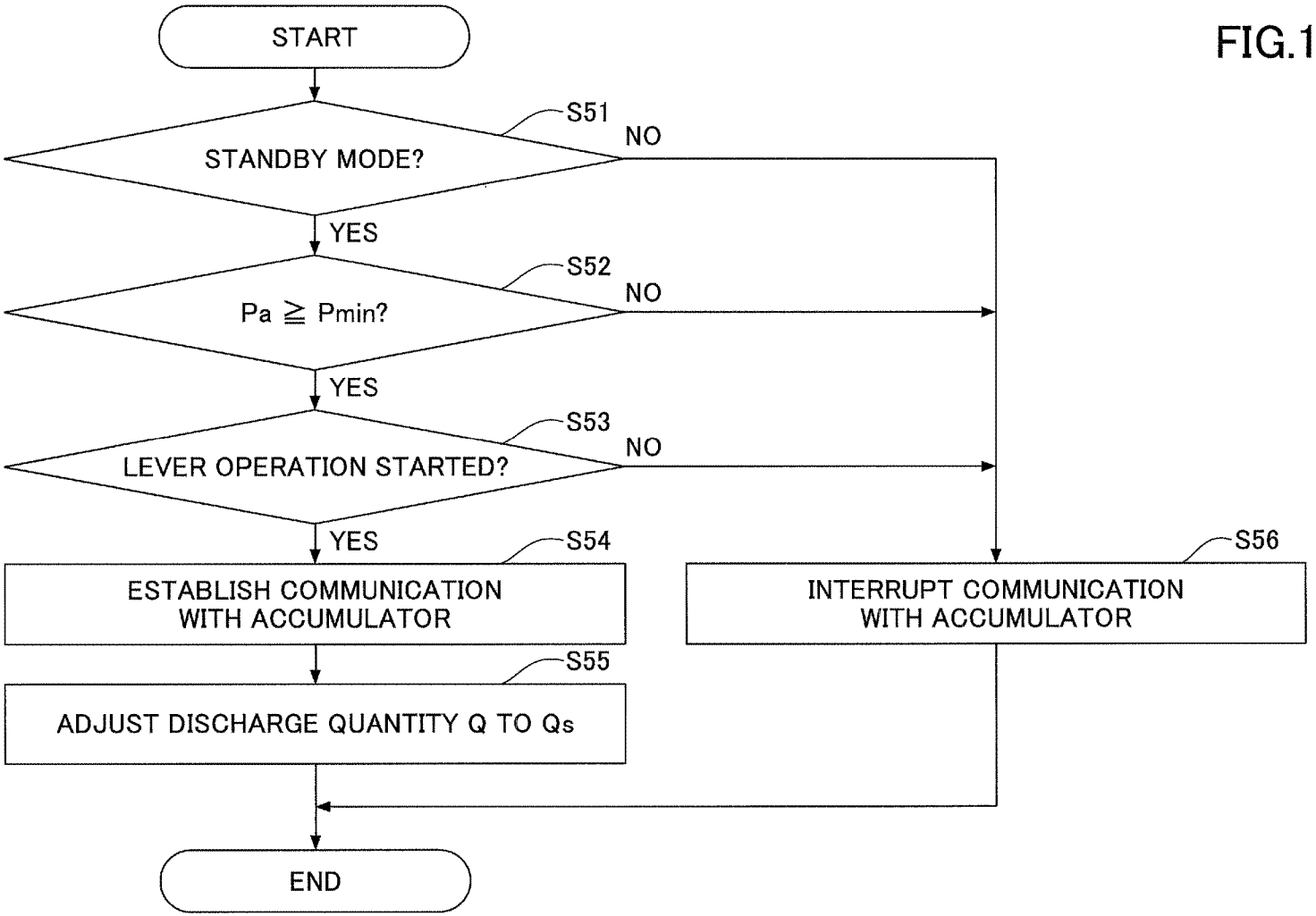
FIG. 17 is a flowchart illustrating a flow of the absorbed horsepower increasing operation executed in the hydraulic system of FIG. 15.

Next, a description is given, with reference to FIG. 17, of the absorbed horsepower increasing operation executed in the hydraulic system of FIG. 15. FIG. 17 is a flowchart illustrating a flow of the absorbed horsepower increasing operation executed in the hydraulic system of FIG. 15. According to the absorbed horsepower increasing operation of FIG. 17, the horsepower absorbed by the main pump 14 is temporarily and automatically increased when a lever operation is started regardless of whether the atmospheric pressure is high or low, the same as in the absorbed horsepower increasing operation of FIG. 8. Therefore, according to this embodiment, the switch 50 is omitted, and it is possible for the controller 30 to have the absorbed horsepower increase necessity/unnecessity determination part 300 and the absorbed horsepower control part (discharge quantity control part) 301 enabled at all times. Alternatively, the absorbed horsepower increasing operation according to this embodiment may be caused to function only when the atmospheric pressure is relatively low, using the switch 50 or the atmospheric pressure sensor P1.

First, the absorbed horsepower increase necessity/unnecessity determination part 300 of the controller 30 determines whether the shovel is in the standby mode (step S51). According to this embodiment, like in the absorbed horsepower increasing operation of FIG. 8, the absorbed horsepower increase necessity/unnecessity determination part 300 determines whether the shovel is in the standby mode based on whether or not the discharge pressure of the main pump 14 is a predetermined pressure or more.

If the absorbed horsepower increase necessity/unnecessity determination part 300 determines that the shovel is in the standby mode (there is no hydraulic load) (YES at step S51), the controller 30 determines whether or not the accumulator pressure Pa is at or above a minimum value Pmin (step S52). According to this embodiment, the controller 30 determines whether or not the accumulator pressure Pa output by the pressure sensor P5 is at or above the minimum value Pmin, which is a preset value.

In response to determining that the accumulator pressure Pa is at or above the minimum value Pmin (YES at step S52), the controller 30 determines whether a lever operation has been started (step S53). According to this embodiment, the controller 30 determines whether a lever operation has been started based on the output of the pressure sensor 29.

In response to determining that a lever operation has been started (YES at step S53), the controller 30 causes the junction on the downstream side of the main pump 14 to communicate with the accumulator 810 for a predetermined time (step S54). Specifically, the controller 30 sets the third selector valve 840 to the second position so as to cause the junction on the downstream side of the main pump 14 to communicate with the accumulator 810. Then, the controller 30 stops the negative control, and adjusts the discharge quantity Q of the main pump 14 to the absorbed horsepower increase time flow rate Qs that is greater than the negative control flow rate Qn (step S55). Alternatively, the controller 30 may maintain the negative control flow rate Qn as it is without stopping the negative control.

On the other hand, in response to determining that no lever operation has been started (NO at step S53), the controller 30 interrupts the communication between the junction on the downstream side of the main pump 14 and the accumulator 810 (step S56). Specifically, the controller 30 sets the third selector valve 840 to the first position so as to interrupt the communication between the junction on the downstream side of the main pump 14 and the accumulator 810. Then, the controller 30 starts the negative control if the negative control has been stopped. This is for adjusting the discharge quantity Q of the main pump 14 to a flow rate corresponding to the negative control pressure within the range of the total horsepower control curve (see FIG. 4).

Furthermore, also in response to determining that the accumulator pressure Pa is below the minimum value Pmin (NO at step S52), the controller 30 interrupts the communication between the junction on the downstream side of the main pump 14 and the accumulator 810 (step S56), and starts the negative control if the negative control has been stopped.

Furthermore, also in the case of the absorbed horsepower increase necessity/unnecessity determination part 300 determining that the shovel is not in the standby mode (there is a hydraulic load) (NO at step S51), for example, determining that the discharge pressure of the main pump 14 is a predetermined pressure or more, the controller 30 interrupts the communication between the junction on the downstream side of the main pump 14 and the accumulator 810 (step S56), and starts the negative control if the negative control has been stopped.

Alternatively, the absorbed horsepower increase necessity/unnecessity determination part 300 may determine whether the shovel is in the standby mode based on whether or not the discharge pressure of the main pump 14 is a predetermined pressure or more, whether a predetermined time has passed since the stoppage of the negative control, whether the negative control pressure is less than a predetermined pressure, or any of their combinations.

Thus, when a lever operation is started, the controller 30 temporarily and automatically increases the horsepower absorbed by the main pump 14 by causing the accumulator pressure Pa to act on the discharge side of the main pump 14. Therefore, by imposing a predetermined load on the engine 11, it is possible for the controller 30 to increase the supercharging pressure of the supercharging device 11*a* even when a hydraulic load due to an external force is not yet generated. That is, it is possible to increase supercharging pressure by a predetermined amount prior to a hydraulic load increase due to an external force without directly controlling the engine 11 and the supercharging device 11*a*. As a result, even in the case of a sudden hydraulic load increase due to an external force, it is possible for the supercharging device 11*a* to generate a supercharging pressure that matches a hydraulic load that increases in accordance with an external force before a decrease in the engine rotational speed (a decrease in workability) or an engine stall is caused. If an increase in supercharging pressure does not catch up with a hydraulic load (engine load) increase due to an external force, the engine 11 is prevented from sufficiently increasing the amount of fuel injection, thus decreasing the engine rotational speed. In some cases, the engine 11 fails to increase the engine rotational speed and goes on to stall.

Figure 18:
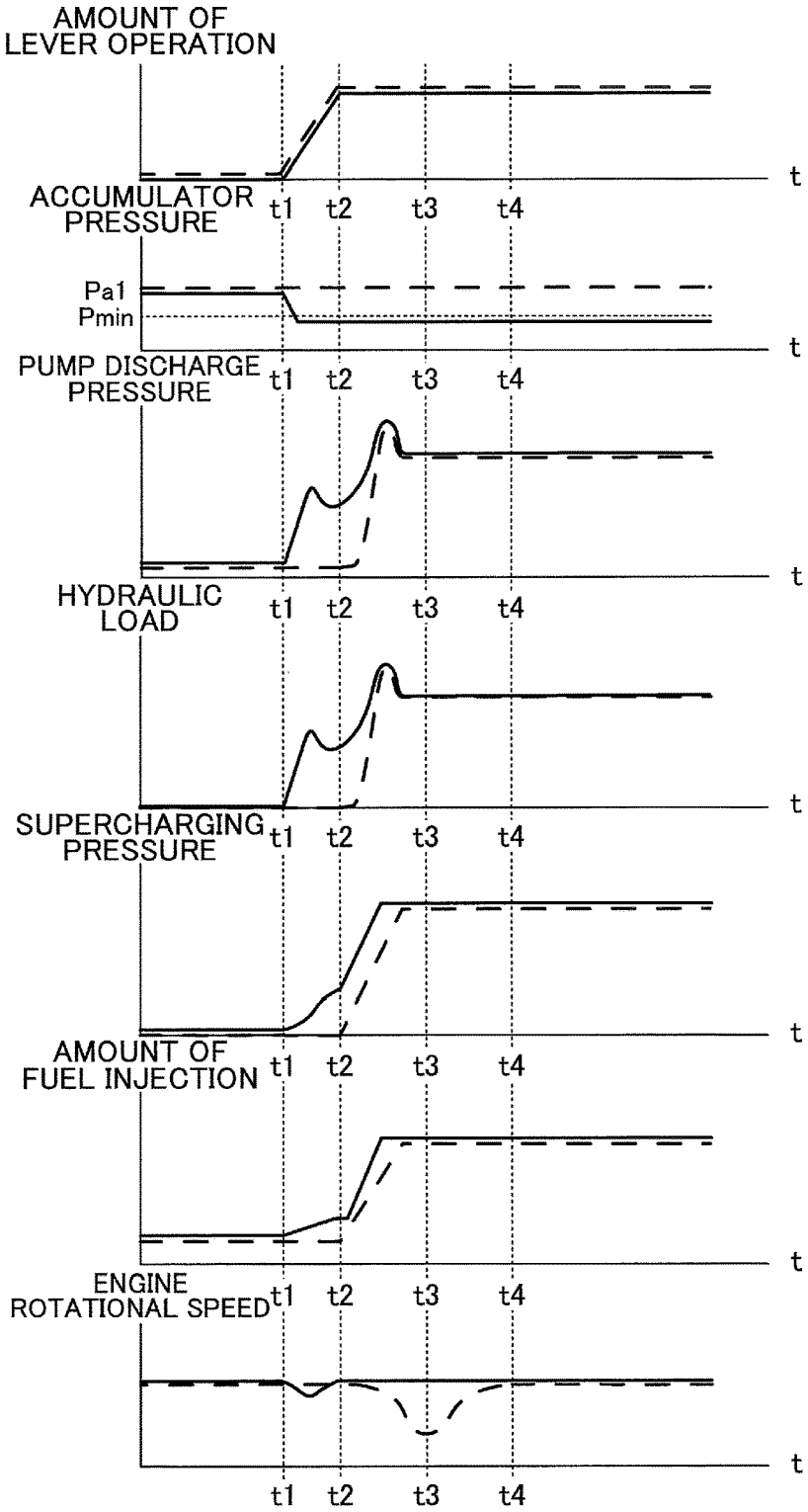
FIG. 18 is a chart illustrating temporal transitions of various physical quantities in the case of executing the absorbed horsepower increasing operation of FIG. 17.

Next, a description is given, with reference to FIG. 18, temporal transitions of various physical quantities in the case of executing the absorbed horsepower increasing operation of FIG. 17. FIG. 18 is a chart illustrating temporal transitions of such various physical quantities, showing the respective temporal transitions of, in order from top to bottom, the amount of a lever operation, accumulator pressure, pump discharge pressure, a hydraulic load (the horsepower absorbed by the main pump 14), supercharging pressure, the amount of fuel injection, and the engine rotational speed. Furthermore, the transitions indicated by a solid line in FIG. 18 indicate transitions in the case of executing the absorbed horsepower increasing operation of FIG. 17, and the transitions indicated by a broken line in FIG. 18 indicate transitions in the case of not executing the absorbed horsepower increasing operation of FIG. 17.

According to this embodiment, it is assumed that, for example, a lever operation for moving the arm 5 for excavation is started at time t1.

First, for comparison, a description is given of temporal transitions of various physical quantities in the case of not executing the absorbed horsepower increasing operation of FIG. 17. The temporal transition of the amount of a lever operation of the arm operation lever is the same as in the case of FIG. 6 and the case of FIG. 9, and accordingly, its description is omitted.

In the case of not executing the absorbed horsepower increasing operation of FIG. 17, the accumulator pressure (see a broken line) remains at a value Pa1. This is because even when a lever operation is started, the controller 30 does not cause the junction on the downstream side of the main pump 14 to communicate with the accumulator 810. Furthermore, the pump discharge pressure and the hydraulic load (see a broken line) remain unincreased until time t2. Thereafter, at time t2, when the arm 5 comes into contact with the ground, the pump discharge pressure and a hydraulic load increase in response to an increase in the excavation reaction force.

Furthermore, supercharging pressure (see a broken line) as well remains unincreased until time t2, and is relatively low at time t2. Therefore, the supercharging device 11*a* is prevented from causing an increase in supercharging pressure to follow an increase in the hydraulic load after time t2. As a result, the engine 11 is prevented from sufficiently increasing the amount of fuel injection so as to cause shortage of the engine output, thus failing to maintain and decreasing the engine rotational speed. In some cases, the engine 11 fails to increase the engine rotational speed and goes on to stall. In the example of FIG. 18, the amount of fuel injection (see a broken line) starts to increase at time t2, and gradually increases with the restriction of a relatively low supercharging pressure. As a result, the engine rotational speed (see a broken line) starts to decrease at time t2, and after reaching a minimum value at time t3, returns to the original engine rotational speed at time t4.

On the other hand, in the case of executing the absorbed horsepower increasing operation of FIG. 17, the accumulator pressure (see a solid line) starts to decrease from the value Pa1 at time t1, and decreases until falling below the minimum value Pmin. This is because the controller 30 causes the junction on the downstream side of the main pump 14 to communicate with the accumulator 810 in response to determining that a lever operation has been started. As a result, the pump discharge pressure and a hydraulic load (see a solid line) start to increase at time t1 before application of a load on a hydraulic actuator, and increase to a predetermined level before time t2. Then, a load on the engine 11 as well increases in response to this increase in the hydraulic load corresponding to the horsepower absorbed by the main pump 14. At this point, the engine 11*a* increases supercharging pressure with the supercharging device 11*a* in order to maintain a predetermined engine rotational speed. Therefore, supercharging pressure (see a solid line) starts to increase at time t1, and increases to a predetermined level before time t2. Therefore, it is possible for the supercharging device 11*a* to increase supercharging pressure without lagging far behind a hydraulic load increase after time t2. As a result, it is possible for the engine 11 to maintain the engine rotational speed (see a solid line) without causing shortage of the engine output. In the example of FIG. 18, the amount of fuel injection (see a solid line) starts to increase at time t1, and after time t2 as well, increases with good responsiveness, being free of supercharging pressure restrictions. As a result, the engine rotational speed (see a solid line) remains constant except for a slight decrease between time t1 and time t2 due to an automatic increase in the horsepower absorbed by the main pump 14.

Thus, the controller 30 automatically causes a hydraulic load increase that is not due to an external force by increasing the discharge pressure of the main pump 14 using hydraulic oil stored in the accumulator 810 before a hydraulic load increases because of an external force such as an excavation reaction force after the start of a lever operation, regardless of an increase or decrease in a reaction force that the bucket 6 receives from a work target. Then, the controller 30 increases supercharging pressure to a relatively high level by indirectly affecting the supercharging device 11*a* of the engine 11 by increasing an engine load by increasing the horsepower absorbed by the main pump 14. As a result, it is possible for the controller 30 to swiftly increase supercharging pressure that is already at a relatively high level even in the case of a sudden hydraulic load increase due to an external force such as an excavation reaction force. Furthermore, no decrease in the engine rotational speed (decrease in workability) or no engine stall is caused at the time of increasing supercharging pressure.

All examples and conditional language provided herein are intended for pedagogical purposes of aiding the reader in understanding the invention and the concepts contributed by the inventor to further the art, and are not to be construed as limitations to such specifically recited examples and conditions, nor does the organization of such examples in the specification relate to a showing of the superiority or inferiority of the invention. Shovels and methods of controlling a shovel have been described based on embodiments of the present invention. It should be understood, however, that various changes, substitutions, and alterations could be made hereto without departing from the spirit and scope of the invention.

For example, the turning mechanism 2, which is hydraulic according to the above-described embodiments, may be electric.

Furthermore, according to the above-described embodiments, the controller 30 stops the negative control by outputting a control signal to the regulator 13. Specifically, the controller 30 makes it possible to control the discharge quantity regardless of the negative control pressure by substantially disabling the negative control by generating a control pressure higher than the negative control pressure. The present invention, however, is not limited to this configuration. For example, the controller 30 may stop the negative control by interrupting the communications between the negative control throttles 18L and 18R and the regulators 13L and 13R by outputting a control signal to solenoid valves (not graphically represented) disposed in the negative control pressure conduits 41L and 41R. Specifically, the controller 30 may make it possible to control the discharge quantity regardless of the negative control pressure by substantially disabling the negative control by interrupting the communications between the negative control throttles 18L and 18R and the regulators 13L and 13R.

Furthermore, according to the above-described embodiments, a description is given of examples where the present invention is applied to a hydraulic shovel, while the present invention may also be applied to a hybrid shovel in which the engine 11 and a motor generator are connected to the main pump 14 so as to drive the main pump 14.

What is claimed is:

1. A shovel, comprising:

a lower-part traveling body;

an upper-part turning body mounted on the lower-part traveling body;

a hydraulic actuator mounted on the upper-part turning body;

an internal combustion engine disposed in the upper-part turning body, the internal combustion engine being provided with a supercharging device and configured to be controlled at a constant rotational speed;

a hydraulic pump connected to the internal combustion engine; and a controller configured to control horsepower absorbed by the hydraulic pump, wherein the controller is configured to increase a supercharging pressure of the supercharging device by increasing a load on the internal combustion engine with the hydraulic pump before a load on the hydraulic actuator increases.

2. The shovel as claimed in claim 1, further comprising:

an end attachment, wherein the controller is configured to increase the horsepower absorbed by the hydraulic pump regardless of an increase or a decrease in a reaction force that the end attachment receives from a work target.

3. The shovel as claimed in claim 1, wherein the controller is configured to increase the horsepower absorbed by the hydraulic pump before the load on the hydraulic actuator increases by increasing a discharge quantity of the hydraulic pump in a standby mode in which no hydraulic actuator of the shovel is operated.

4. The shovel as claimed in claim 3, wherein said increasing the discharge quantity is achieved by adjusting a regulator for the hydraulic pump.

5. The shovel as claimed in claim 4, wherein said adjusting the regulator is executed in response to a command from the controller.

6. The shovel as claimed in claim 5, wherein said adjusting the regulator includes stopping negative control.

7. The shovel as claimed in claim 3, wherein the hydraulic pump includes a first variable displacement hydraulic pump and a second variable displacement hydraulic pump having a smaller maximum discharge quantity than the first variable displacement hydraulic pump, and the controller is configured to increase the horsepower absorbed by the hydraulic pump before the load on the hydraulic actuator increases by adjusting a regulator for the second variable displacement hydraulic pump.

8. The shovel as claimed in claim 1, wherein the controller is configured to increase the horsepower absorbed by the hydraulic pump before the load on the hydraulic actuator increases by increasing a discharge pressure of the hydraulic pump in a standby mode in which no hydraulic actuator of the shovel is operated.

9. The shovel as claimed in claim 8, comprising:

a valve configured to restrict a flow of hydraulic oil discharged by the hydraulic pump, wherein the controller is configured to increase the discharge pressure of the hydraulic pump in the standby mode by controlling the valve.

10. The shovel as claimed in claim 8, further comprising:

an accumulator configured to store hydraulic oil discharged from the hydraulic actuator and capable of discharging the hydraulic oil to a discharge side of the hydraulic pump, wherein the controller is configured to increase the discharge pressure of the hydraulic pump in the standby mode by discharging the hydraulic oil from the accumulator in response to determining a start of a lever operation for the hydraulic actuator.

11. The shovel as claimed in claim 1, wherein the controller is configured to control the horsepower absorbed by the hydraulic pump before the load on the hydraulic actuator increases in accordance with atmospheric pressure.

12. The shovel as claimed in claim 1, wherein the controller is configured to increase the load on the internal combustion engine with the hydraulic pump before the load on the hydraulic actuator increases, to increase an amount of fuel injection before the load on the hydraulic actuator increases.

13. The shovel as claimed in claim 1, wherein the controller is configured to increase the load on the internal combustion engine in a standby mode in which no hydraulic actuator of the shovel is operated or to increase the load on the internal combustion engine within a predetermined time after a start of an operation of the hydraulic actuator, and before the load on the hydraulic actuator increases.

14. A method of controlling a shovel including a lower-part traveling body, an upper-part turning body mounted on the lower-part traveling body, a hydraulic actuator mounted on the upper-part turning body, an internal combustion engine disposed in the upper-part turning body, the internal combustion engine being provided with a supercharging device and configured to be controlled at a constant rotational speed, a hydraulic pump connected to the internal combustion engine, and a controller configured to control horsepower absorbed by the hydraulic pump, the method comprising:

increasing, by the controller, a supercharging pressure of the supercharging device by increasing a load on the internal combustion engine with the hydraulic pump before a load on the hydraulic actuator increases.

15. The method of controlling a shovel as claimed in claim 14, wherein the controller increases the horsepower absorbed by the hydraulic pump before the load on the hydraulic actuator increases by increasing a discharge quantity of the hydraulic pump in a standby mode in which no hydraulic actuator of the shovel is operated.

16. The method of controlling a shovel as claimed in claim 14, wherein the controller increases the horsepower absorbed by the hydraulic pump before the load on the hydraulic actuator increases by increasing a discharge pressure of the hydraulic pump in a standby mode in which no hydraulic actuator of the shovel is operated.

17. The method of controlling a shovel as claimed in claim 14, wherein the controller increases the load on the internal combustion engine with the hydraulic pump before the load on the hydraulic actuator increases, to increase an amount of fuel injection before the load on the hydraulic actuator increases.

18. The method of controlling a shovel as claimed in claim 14, wherein the controller increases the load on the internal combustion engine in a standby mode in which no hydraulic actuator of the shovel is operated or increases the load on the internal combustion engine within a predetermined time after a start of an operation of the hydraulic actuator, and before the load on the hydraulic actuator increases.

* * * * *